US005368471A

United States Patent [19]

Kychakoff et al.

[11] Patent Number: 5,368,471

[45] Date of Patent: Nov. 29, 1994

[54] METHOD AND APPARATUS FOR USE IN MONITORING AND CONTROLLING A BLACK LIQUOR RECOVERY FURNACE

[75] Inventors: George Kychakoff, Maple Valley; Stephen N. Anderson; George E. Seymore, both of Tacoma, all of Wash.; Earl B. Manchester, Boulder, Colo.

[73] Assignee: The Babcock & Wilcox Company, New Orleans, La.

[21] Appl. No.: 796,548

[22] Filed: Nov. 20, 1991

[51] Int. Cl.[5] ..... H04N 7/18

[52] U.S. Cl. ..... 431/12; 431/13; 431/75; 110/186; 162/31; 374/137; 356/376; 356/379; 348/61

[58] Field of Search ..... 431/12, 13, 10, 8, 7, 431/79, 75, 170; 110/185, 186, 187; 162/30.1, 30.11, 31; 358/100, 107, 108, 113; 356/376, 379, 380

[56] References Cited

U.S. PATENT DOCUMENTS

| | | | |
|---|---|---|---|
| 3,477,823 | 11/1969 | Freiday | 23/277 |
| 3,814,570 | 6/1974 | Guigues et al. | 431/76 |
| 3,830,969 | 8/1974 | Hofstein | 178/6.8 |
| 4,359,950 | 11/1982 | Leffler et al. | 431/76 X |
| 4,463,437 | 7/1984 | Schenck et al. | 364/557 |
| 4,539,588 | 9/1985 | Ariessohn et al. | 358/113 |
| 4,620,491 | 11/1986 | Nishikawa et al. | 110/185 |
| 4,628,465 | 12/1986 | Ito et al. | 364/521 |
| 4,690,634 | 9/1987 | Herngren et al. | 431/8 |
| 4,737,844 | 4/1988 | Kohola et al. | 358/100 |
| 4,737,917 | 4/1988 | Perron | 364/473 |
| 4,814,868 | 3/1989 | James | 358/100 |
| 4,857,282 | 8/1989 | Mullen | 423/207 |
| 5,010,827 | 4/1991 | Kychakoff et al. | 110/185 |
| 5,139,412 | 8/1992 | Kychakoff et al. | 431/12 |

FOREIGN PATENT DOCUMENTS

| | | | |
|---|---|---|---|
| 3331478 | 3/1985 | Germany | 431/18 |
| 0058228 | 5/1979 | Japan | 431/75 |
| 57-84917 | 5/1982 | Japan . | |
| 59-1919 | 1/1984 | Japan . | |
| 60-245921 | 12/1985 | Japan | 431/13 |
| 62-29828 | 7/1987 | Japan . | |
| 62-267728 | 4/1989 | Japan | 431/13 |
| 2-17316 | 1/1990 | Japan | 431/18 |

OTHER PUBLICATIONS

Anderson et al., "Monitoring of Recovery Boiler Interiors Using Imaging Technology," published in Apr. of 1989 by a division of Weyerhaeuser Company.

*Primary Examiner*—Carl D. Price

*Attorney, Agent, or Firm*—Klarquist, Sparkman, Campbell, Leigh & Whinston

[57] ABSTRACT

A system for monitoring, controlling, and optimizing the operation of a kraft chemical recovery furnace which includes a mechanism for determining carryover particle counts, bed profile information, and temperature information of a smelt the bed over a major portion of the bed. The location and temperatures of high and low temperature spots on the bed can be determined. This information may be displayed in a convenient manner, such as on a common screen, for use by the furnace operator in controlling the furnace. Trending and history of bed performance in relationship to these characteristics may be tracked for use in diagnosing furnace operating problems and in adjusting parameters of the furnace to enhance furnace performance.

24 Claims, 22 Drawing Sheets

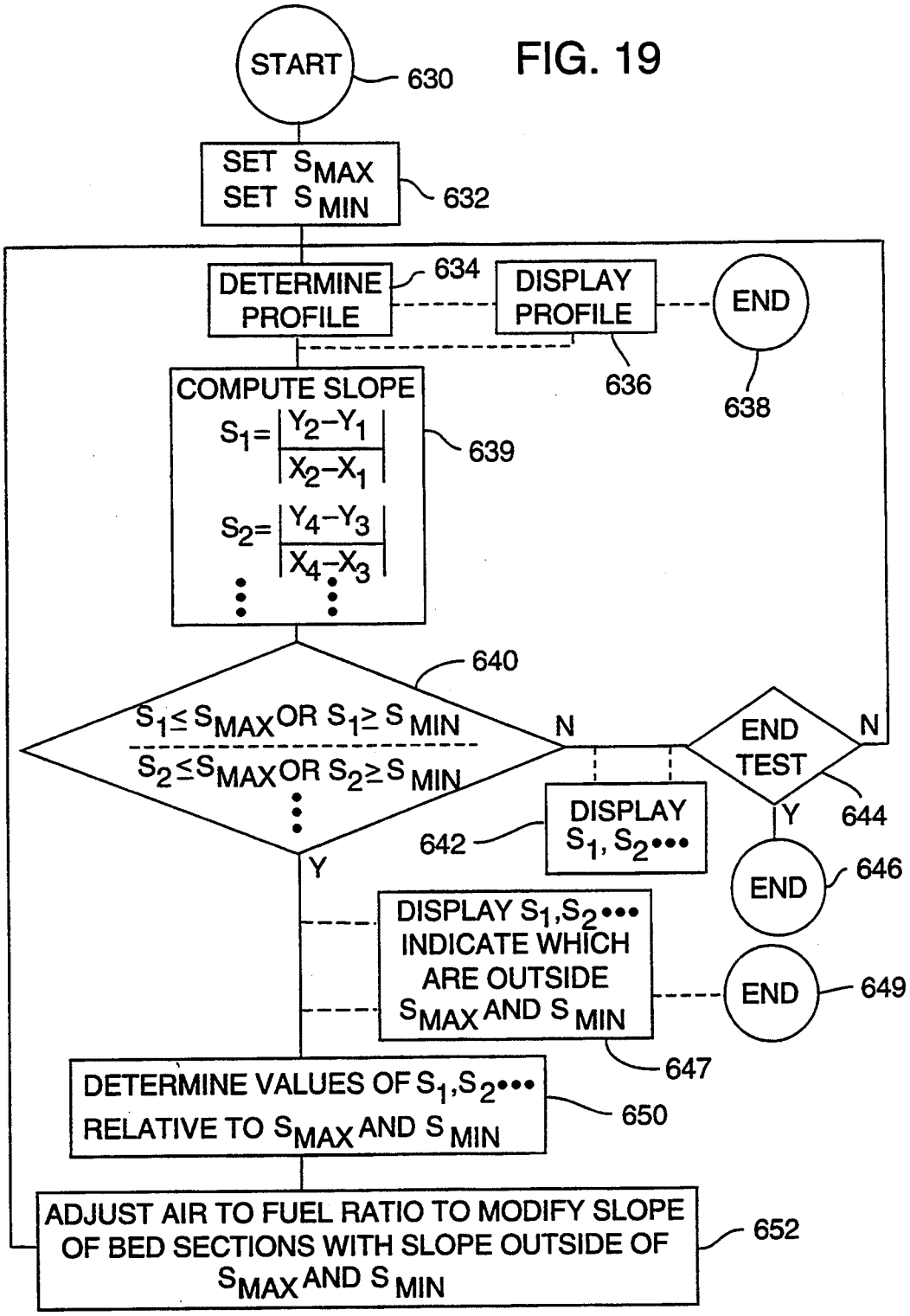
FIG. 19
START
630
SET $S_{MAX}$
SET $S_{MIN}$
632
DETERMINE PROFILE
634
DISPLAY PROFILE
636
END
638
COMPUTE SLOPE
$S_1 = \left|\frac{Y_2-Y_1}{X_2-X_1}\right|$
$S_2 = \left|\frac{Y_4-Y_3}{X_4-X_3}\right|$
639
640
$S_1 \leq S_{MAX}$ OR $S_1 \geq S_{MIN}$
$S_2 \leq S_{MAX}$ OR $S_2 \geq S_{MIN}$
N
Y
END TEST
N
Y
644
DISPLAY $S_1, S_2$•••
642
END
646
DISPLAY $S_1, S_2$••• INDICATE WHICH ARE OUTSIDE $S_{MAX}$ AND $S_{MIN}$
END
649
647
DETERMINE VALUES OF $S_1, S_2$••• RELATIVE TO $S_{MAX}$ AND $S_{MIN}$
650
ADJUST AIR TO FUEL RATIO TO MODIFY SLOPE OF BED SECTIONS WITH SLOPE OUTSIDE OF $S_{MAX}$ AND $S_{MIN}$
652

METHOD AND APPARATUS FOR USE IN MONITORING AND CONTROLLING A BLACK LIQUOR RECOVERY FURNACE

BACKGROUND OF THE INVENTION

The present invention relates to the monitoring of selected operating characteristics of a furnace, the display of these characteristics and the use of these characteristics in the optimization and control of a furnace. More specifically, the present invention relates to the monitoring, display, optimization and control of the performance of a kraft process chemical recovery furnace of the type in which black liquor fuel is introduced and burned to produce a smelt bed at a lower region of the furnace.

The monitoring of a hot infrared emitting surface obscured by particulate fume and hot gases, such as found in kraft pulp recovery boilers, is a difficult task. That is, interference from fume particles and gaseous radiation within the furnace tends to obscure the view of hot surfaces, such as of the smelt bed and background, under such adverse environmental conditions.

U.S. Pat. No. 4,539,588 to Ariessohn, et al. describes one form of an apparatus for this purpose. In particular, the Ariessohn, et al. device comprises a closed circuit video camera fitted with an infrared imaging detector or vidicon tube. An objective lens obtains the image. An optical filter interposed between the lens and vidicon is selected to reject radiation in all but limited ranges of radiation to avoid interference by gaseous species overlaying the smelt bed, such gases being strongly emitting and absorbing. As a specific example, a spectral filter centered at 1.65 μm with a band width of 0.3 μm is noted as being suitable for imaging a kraft recovery smelt bed.

A product known as TIPS TM from the Sensor and Simulation Products Division of Weyerhaeuser Company of Tacoma, Wash., incorporates the device of the Ariessohn, et al. patent in a temperature image processing and storage system. The TIPS TM system creates digitally colorized images of the smelt bed for viewing by an operator. In the TIPS TM system, due to the partial elimination of the effects of moving particles in the image, the view of active scenes on the bed is permitted. The TIPS TM system is especially designed for displaying temperature trends of the bed on digital and graphic displays and for tracking changes from a reference temperature at a selected location in the process, or to observe temperature differences between locations. In addition, the TIPS TM system allows the production and storage of historical temperature changes. Moreover, the TIPS TM system permits the manual adjustment of a reference temperature for purposes of comparison.

The TIPS TM system has a number of advantages, but also suffers from limitations. The TIPS TM system provides limited temperature information concerning the smelt bed. That is, the pyrometer is utilized to determine a temperature over a small calibration window. An observation window, representing about 2–3 percent of the digital image displayed on a screen, is then moved to a desired location on the screen with the temperature then being determined within that observation window relative to the temperature in the calibration window. In general, the intensity of the signal in the calibration window is known, and the temperature in the calibration window is known from the pyrometer (subject to errors as mentioned above). Therefore, the temperature in the observation window can be inferred by comparing the intensity of the image in the observation window to the intensity of the image in the calibration window. In this way, limited spot temperature information at various locations throughout the image can be obtained by shifting the small observation window. Also, in the TIPS TM system, a pyrometer is used with a field of view which is separate from the field of view of the video camera. Consequently, errors can be introduced into this system due to the difficulty in precisely matching the location of the field of view of the pyrometer to the location in the field of view of the camera for calibration purposes.

The capabilities of the TIPS TM system are described in greater detail in an article published in April 1989 entitled "Monitoring of Recovery Boiler Interiors Using Imaging Technology," by Anderson, et al. (CPPA-TAPPI 1989, International Chemical Recovery Conference). In addition to discussing the imaging of a bed for purposes of developing temperature trend information, this particular article mentions that adequate smelt reduction requires sufficient bed residence time, which is influenced by bed configuration. The article also recites that both of these issues can be addressed by a bed-level monitoring system which can extract the bed profile and alert the operators when the bed drifts out of the user-defined range. The article then mentions that the Weyerhaeuser (TIPS TM ) system has the capability to detect bed height so as to provide a control signal for those interested in using bed height or slope for control purposes. However, this article does not provide any information on how these goals would be accomplished.

U.S. Pat. No. 4,737,844 to Kohola, et al. describes a system utilizing a video camera for obtaining a video signal which is digitized and filtered temporally and spatially. The digitized video signal is divided into signal subareas with feature elements belonging to the same subarea being combined into continuous image areas corresponding to a certain signal level. The combined subareas are then processed to provide an integrated image which is averaged to eliminate the effect of random disturbances. The averaged image is displayed on a display device. The images may then be compared to optimum conditions. Areas corresponding to effective combustion and the flame front of a bed are then defined, using histograms, and identified by means of their area, point of gravity coordinates of the area and point-by-point recorded contours of the area. In addition, the contours of voids inside the area are defined. In an application described in the Kohola, et al. patent, the flame front, location and shape of the fuel bed is determined.

In Kohola, et al., the material to be burned is shown as a bed of substantially identical thickness and width. This bed is delivered to the mill end of a boiler stoker where the flame front is concentrated. Thus, Kohola, et al. is described in conjunction with a bed of a substantially uniform contour and is not directed toward beds such as are found in smelt bed boilers which are burning throughout substantially their entire surface and wherein the contours of the bed vary depending upon furnace operating parameters, such as the fuel-to-air ratio.

In U.S. Pat. No. 5,139,412, to Kychakoff, et al. and entitled "Method and Apparatus for Profiling the Bed of a Furnace," the determination of characteristics of the shape and volume of a smelt bed of a black liquor furnace is described. This patent application is hereby incorporated by reference herein. In accordance with this description, a digital image of the bed and background is produced. The digital image is then processed to determine transitions in the image which correspond to transitions between the bed and background and thereby to the profile and boundary of the bed. The determination of bed characteristics comprising the bed profile, bed height, slope and the volume of the bed is disclosed. These characteristics are displayed, or otherwise used, for example, in the control of the parameters affecting the operation of the furnace, such as in controlling the air-to-fuel ratio in the furnace.

The Kychakoff, et al. disclosure also mentions the provision of a reference bed characteristic and the comparison of the determined bed characteristic with the reference bed characteristic. In the event of a difference in excess of a threshold, an alarm or other indicator is activated. Alternatively, use of the determined bed characteristics in the automatic control of a furnace, and in particular air-to-fuel ratios, is described. Histories of these characteristics may be stored and correlated to furnace performance characteristics, such as fuel efficiency, reduction efficiency and the like, for use in developing a target bed configuration which optimizes these conditions. The furnace is then operated to provide a determined bed which matches the target bed.

In accordance with the Kychakoff disclosure, digital images of the bed are obtained and processed to determine transitions indicative of the boundary of the bed. The processing approach described in this patent includes the steps of selecting images from the plural digital images for clarity; temporally averaging the selected images; differentiating the images following temporal averaging; smoothing the images; and thereafter locating transitions in the images. The step of locating transitions is described as including the performance of a continuity check and/or a region growing process.

Although this Kychakoff, et al. invention provides a desirable approach for determining bed profiles, there is nevertheless a need for improvements in bed characteristic determination. In addition, this Kychakoff, et al. invention does not recognize the complex interaction between furnace operating parameters and characteristics other than those associated with the bed profile.

The problem of carryover particles in kraft chemical recovery boilers has heretofore been recognized. In general, carryover particles may be defined as "out-of-place" burning particles that are traveling in a furnace or boiler in a region well above the hearth of the furnace. More specifically, carryover particles in smelt bed recovery boilers may be defined as the mass of burning or hot smelt particles passing a horizontal plane at an upper level of the boiler, such as at the "bull nose" level within the boiler. Burning particles which encounter steam tubes in such a recovery boiler are quenched and form hard deposits on the tubing. These hard deposits are difficult to clean or remove through the use of typical steam cleaning mechanisms in such boilers. These particles typically contain sodium sulfate and sodium carbonate, but may also include other components to a varying extent, such as residual organics from the black liquor.

Devices for detecting carryover particles in the interior of furnaces, such as kraft process chemical recovery furnaces, are known. One such device is disclosed in U.S. Pat. No. 5,010,827 to Kychakoff, et al., which is incorporated by reference herein. This Kychakoff, et al. device utilizes plural spaced apart detectors for monitoring discrete portions of the interior of a furnace for the purpose of detecting carryover particles at such monitored locations. Signals indicative of the carryover particles are processed to obtain a count of the carryover particles. The carryover particle count may then be displayed. For example, the signals from all of the detectors may be averaged with trends and overall changes in count rates then displayed. In addition, the counts from the individual detectors may be displayed to assist an operator in locating the source of excessive carryover particles in the furnace. The information on carryover particle count may be used in controlling parameters affecting the performance of the furnace directly or indirectly by way of operator input. This patent specifically mentions that under certain boiler or furnace conditions, such as resulting from disturbances in the air supply or perhaps due to a high bed volume in the boiler, carryover particle increases may occur. The control of air and fuel flow in response to carryover particle count is also specifically mentioned in this patent.

Although the invention of U.S. Pat. No. 5,010,827 offers a number of advantages, this patent does not recognize the importance of simultaneously monitoring characteristics of a furnace in addition to carryover particles. U.S. Pat. Nos. 4,690,634 to Herngren, et al., and 4,814,868 to James also relate to the monitoring of carryover particles in boilers. U.S. Pat. No. 3,830,969 to Hofstein describes yet another system for detecting particles. These latter systems suffer from limitations in their ability to accurately detect carryover particles.

Although systems exist for use in monitoring the interior of recovery boilers, a need exists for an overall improved system for simultaneously monitoring temperature, bed profile and carryover particles in such furnaces. In addition, improvements in bed profile and temperature determinations are also highly desirable. In addition, a need exists for a method and apparatus for monitoring plural furnace operating characteristics and which facilitates the display of this information for use in monitoring, optimizing and controlling the operation of a kraft process chemical recovery furnace.

SUMMARY OF THE INVENTION

A method and apparatus is described for use in monitoring a kraft chemical recovery furnace of the type in which black liquor fuel is injected into a combustion chamber and burned therein to form a smelt bed of chemicals to be recovered. In accordance with the invention, the profile of the bed viewed from at least one direction is determined with an output signal representing the bed profile being provided. In addition, the temperature of the bed over at least a major portion of the bed area represented by the profile is determined with a second output signal representing the temperature of the bed also being provided. Moreover, carryover particles in an upper region of the furnace are detected and a third output signal representing the detected particles is generated. This information is preferably displayed, most preferably on a common display screen, for use by an operator in monitoring and controlling the operation of the black liquor furnace. Instead of or in addition to displaying the information, the information may also be downloaded to a distributed control system of the black liquor furnace for use in automatically controlling the furnace or in the interactive control of the furnace operation by way of operator input in response to the information.

By simultaneously monitoring bed, bed temperature, and carryover particle behavior within a furnace, more precise information is available to an operator of a boiler. That is, the interaction of these boiler performance characteristics may be used to detect problems in boiler operation and also in the optimization of boiler performance, which in many cases would be difficult in the absence of this combined information.

As another aspect of the present invention, the bed temperature determining step preferably includes the step of determining the mean bed temperature over a selected area of the bed. To provide meaningful information, it is preferred that the mean bed temperature be determined over at least two-thirds of the area of the bed profile. Alternatively, or in addition to the mean temperature determination, hot and cold spots in the bed area and under the boundary of the determined bed profile may also be determined. In addition to determining the temperature of these hot and cold spots, their locations may also be determined. Both temperatures and location of the hot and cold spots may be displayed, with the locations preferably being visually displayed at their location on the bed, together with the bed profile to provide the operator of the boiler with direct information relating to furnace performance. This temperature information over time also indicates developing adverse furnace operating conditions. For example, a developing cold spot at an area where excess fuel is reaching the bed indicates potential problems with the fuel supply which could lead to a boiler shut-down if not corrected. Although particularly advantageous when combined with the bed characteristic and carryover particle information, this mean, high, and low temperature determination aspect of the invention is also independently important.

In connection with the bed profile determination portion of the invention, in addition to volume, bed area and bed profile slope information, additional information on bed characteristics may be determined and displayed. For example, the determined peak height of the bed, the width of the bed at a horizontal top bar location which is a selected distance below the peak, and the center of the bed at the bar location. This information is also available for plural views of the bed in the event plural bed viewing cameras are being used.

In determining the bed profile, a digital image of the bed and background is produced and processed to determine transitions in the image corresponding to transitions between the bed and background and thereby to the boundary of the bed. It has been discovered that the application of a simulated thermal annealing analogy to bed transition determinations provides an improved indication of the bed boundary. This technique involves discovering the application of the thermodynamic relationship ($e^{-u/T}$) to smelt bed analysis. In this application u is a function of the group comprising the height of the pixel in the image (the image being comprised of pixels), the strength of the pixel in the image, the memory of the pixel, the continuity of the pixel, and wherein T is a simulated temperature.

It has also been discovered that, due to the relatively slow changes in smelt bed profile characteristics, fast, accurate and efficient bed profile determination does not require an evaluation of each element in an image in order to determine the instantaneous bed profile. Instead, the search for a particular bed boundary point can be limited to an evaluation of potential boundary points within a limited range of the previously determined boundary point for a location in the image.

As yet another aspect of the bed profile determination features of the invention, fixed features in the image, such as air delivery ports, fuel nozzles, and the like, may be identified. The image may then be processed to in effect minimize or eliminate the impact of these fixed features on bed boundary determinations. As a result, the fixed features do not skew or introduce errors into the bed profile determination.

In addition to being particularly beneficial in the overall system of the present invention, the aspects of the invention relating to bed profile determination are also beneficial in other applications relating to bed profile determination.

The determined bed profile characteristics, determined temperature, determined high and low temperatures and locations, if they are being found, and detected carryover particle information may be correlated over time with furnace operating parameters. Examples of such parameters include the fuel temperature, the fuel pressure, the supply of air to the furnace at plural levels and locations, and the fuel nozzle angle, as well as with other furnace operation parameters. A history of these interrelationships may be developed for use in adjusting the furnace operation parameters in response to this determined bed profile, determined temperature, and detected particle information. In addition, particular parameters of furnace operation may be optimized using this information. For example, a single furnace operation parameter may be varied over time with the bed profile, temperature and particle information being monitored until optimum furnace performance is observed. Thereafter, another furnace operating parameter may be adjusted for optimum performance. This procedure may be continued interactively to maximize the performance of the furnace.

It is, therefore, one object of the invention to provide an improved method and apparatus for generating information concerning bed characteristics, bed temperatures, and carryover particles relating to a black liquor fuel furnace.

It is yet another object of the present invention to provide simultaneous information on such characteristics to facilitate the optimization, monitoring and control of a black liquor furnace.

These and other objects, features and advantages of the present invention will become apparent with reference to the following description and drawings.

BRIEF DESCRIPTION OF DRAWINGS

FIG. 19 is a flow chart illustrating the use of the determined profile information to obtain the slope characteristic of the bed and optionally in using such determined slope characteristic in controlling the operation of the furnace.

DETAILED DESCRIPTION OF PREFERRED EMBODIMENTS

A typical kraft process chemical recovery furnace is a black liquor recovery boiler unit used in mills for the manufacture of papermaking pulp. Such units typically require a substantial capital investment. In many cases, the capacity of these boiler units limits the production of the pulp mill. Therefore, it is extremely important that black liquor furnaces are operated close to their optimum capacities under conditions that minimize down time.

Figure 1:
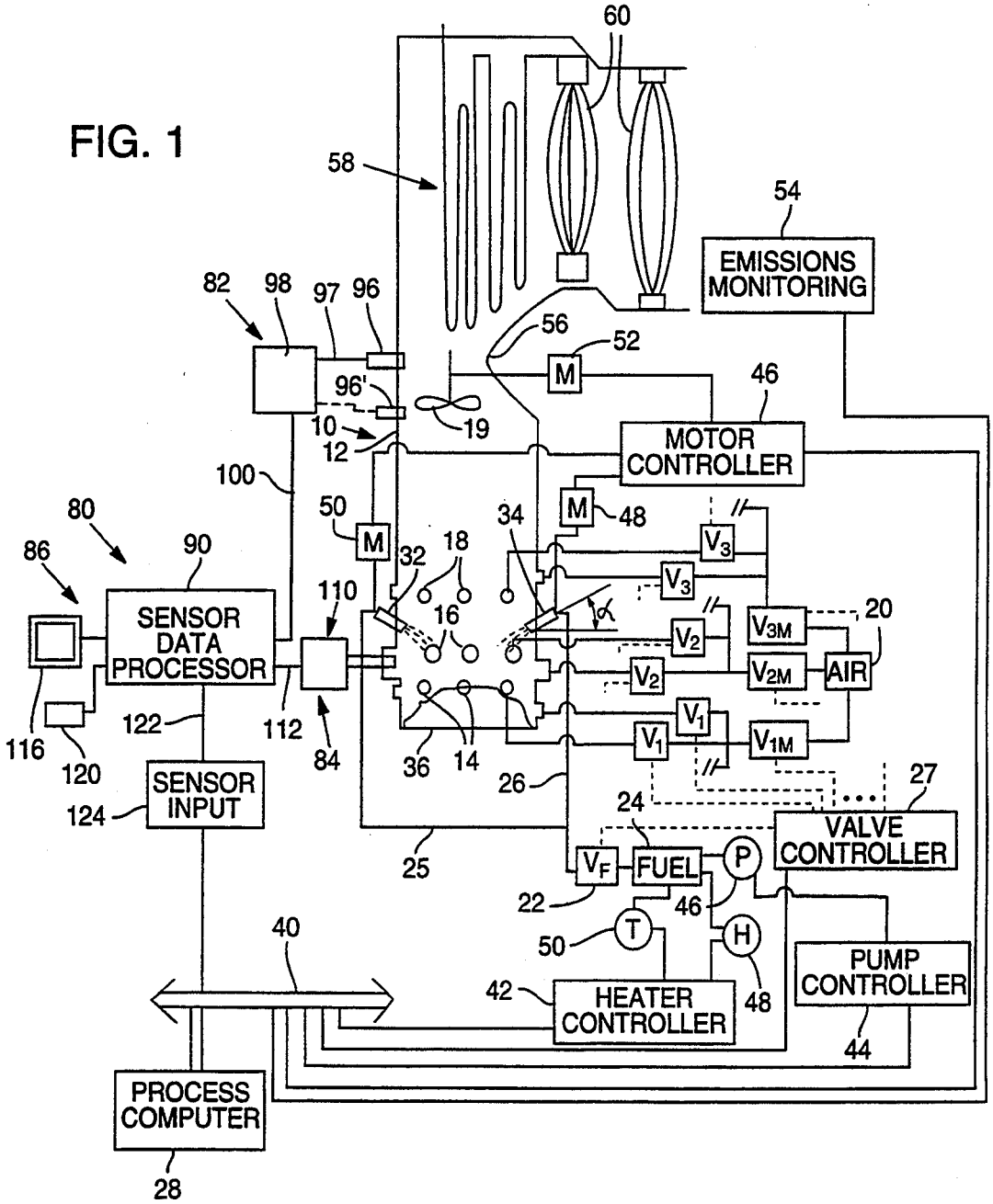
FIG. 1 is a schematic illustration of a monitoring and controlling apparatus of the present invention for use in monitoring and controlling the performance parameters of a furnace, and more specifically, of a kraft chemical recovery boiler.

A conventional liquor recovery unit is shown schematically in FIG. 1, together with a monitoring and display system in accordance with the present invention. The recovery unit comprises a boiler 10 having a surrounding wall 12 through which water is carried for the purpose of steam generation. A typical modern unit of this type has a bottom area of about 50 $m^2$ and a height of about 40 m. Water tubes in the wall 12 and in the bottom of the boiler are connected to a water drum, not shown, and, respectively, to a steam drum. Air is introduced into the furnace through ports located about the circumference of the furnace, normally at two or three different levels. These levels are indicated by numbers 14, 16 and 18, and are also known as primary, secondary and tertiary levels. Air is typically supplied or drawn into the boiler through these ports by large fans, see for example the schematic representation of the draft fan 19. Airflow dampers are controlled to adjust the airflow through these various ports.

Schematically, additional fans are represented by air source 20 in FIG. 1 and some of the dampers are indicated as valves, $V_{1m}$, $V_1$, $V_{2m}$, $V_2$, $V_{3m}$, and $V_3$. In this schematic representation, valves $V_{1m}$, $V_{2m}$ and $V_{3m}$ are main flow valves to the primary, secondary and tertiary levels and operate to control the relative airflow to these different levels. In addition, the valves $V_1$, $V_2$ and $V_3$ respectfully control the flow of air between the various ports at each of the respective primary, secondary and tertiary levels. Another valve $V_f$ is shown at 22 for controlling the flow of fuel from a fuel source 24 to respective fuel lines 25, 26 and two fuel nozzles or guns 32, 34. A valve or damper controller 27, under the control of a process computer 28 of a conventional distributed control system for such boilers and interface (not shown), controls the operation of the various air supply dampers and fuel supply valve to control the flow of combustion air and fuel to the boiler. For example, to increase the rate of fuel combustion in the boiler, the amount of combustion air is typically increased. In addition, by supplying more air through selected ports than through other ports, an increase in the rate of consumption of fuel may be achieved in the regions of greater air supply to adjust the contour of a smelt bed 30 at the bottom of the boiler.

Black liquor fuel enters the boiler through fuel nozzles 32, 34 (typically more such nozzles being included in a boiler than shown) as a coarse spray. Combustible organic constituents in the black liquor burn as the fuel droplets mix with air. Sodium sulfate in the fuel is chemically converted to sodium sulfide in the reducing zone at the lower portion of the boiler. The inorganic salts drop to the floor of the boiler to form the smelt bed, from which liquid is drained. The black liquor fuel is delivered from a fuel source (from the pulp mill) through the valve 22 and to the respective nozzles. The process computer 28 and interface deliver suitable fuel control signals to the valve controller 27 for controlling the valve 22, and thus the supply of fuel. Typically, a control valve is also provided in each of the lines 25, 26 so that fuel supplied to individual nozzles may be independently regulated.

The process computer in FIG. 1 is also shown coupled by a bus 40 and the interface to a heater controller 42, a pump controller 44, and a motor controller 46. A fuel pump 46 responsive to the pump controller pumps fuel from the source 24 to the nozzles 32 and 34. In response to signals from the process computer, operation of pump 46 can be controlled to increase or decrease the fuel pressure. In general, a decrease in fuel pressure tends to increase the size of the drops emitted from fuel nozzles 32 and 34. These larger drops tend to burn less completely as they fall toward the bed and would tend to build up the bed and cool its temperature. Conversely, higher pressure in the fuel lines tends to decrease the drop size. Consequently, the drops may burn more completely, resulting in a decrease in the bed size, or may be carried upwardly as carryover particles. Similarly, process computer 28 controls the heater controller 42 and a heater 48 to control the temperature of the fuel 24, with temperature feedback being obtained by way of a temperature sensor 50. Increasing fuel temperature tends to decrease the viscosity of the fuel, while decreasing fuel temperature tends to increase the fuel viscosity, both changes affecting drop size at the nozzles 32 and 34. The process computer 28 in addition controls the motor controller 46 to provide control signals for a draft fan motor 52. Although gun angle is typically manually controlled, the motor controller 46 may also provide signals for gun angle adjustment motors 48, 50, if used. Typically, the nozzles are adjustable over about a 4 degree range, that is, $\pm 2$ degrees from horizontal. A decrease in viscosity of the fuel, due to higher fuel temperature, tends to result in smaller fuel particles which dry to a greater extent (in comparison to larger fuel particles) as they travel from the nozzle to the smelt bed. If the fuel temperature is increased too much, these small fuel particles tend to dry out too much and be carried upwardly in the boiler as carryover particles. In addition, the bed temperature tends to rise and the bed size tends to decrease. Also, the bed tends to become flatter at the top. Conversely, as the viscosity is increased, due to a lower fuel temperature, larger fuel particles tend to result which are wetter when impacting the smelt bed 30. As a result, carryover particles tend to decrease along with bed temperature and the size of the bed tends to increase. Also, the bed tends to become more sharply peaked and one or more localized cold spots tend to appear on the bed. Of course, like the other furnace operating characteristics, this is a simplistic description as the parameters interact with one another during furnace operation. For example, by varying fuel pressure or gun angle, one can at least partially counteract the effect of an adjustment in fuel temperature. Thus, simultaneous monitoring of temperature, bed and carryover particles in relationship to furnace operating parameters becomes extremely important.

FIG. 1 also illustrates conventional emissions monitoring equipment 54 coupled by an interface and the bus 40 to the process computer 28 to provide yet another variable which can be monitored during furnace operation.

It is desirable that combustion of substantially all of the black liquor fuel is carried out in the lower portion of the boiler 10, well below boiler steam tubes at an upper region of the boiler. However, in practice, dust particles formed in the hearth region of the boiler are carried along with flue gases upwardly through a restricted "bull nose" section 56 of the boiler. These particles in part adhere to the upper heat surfaces of the boiler. Under certain boiler or furnace conditions, uncombusted liquor fuel particles follow along with the upward gas flow. Such particles, as they burn, develop coatings on the heat surfaces which are removed only with great difficulty. Also, some of these particles burn as they contact the heat surfaces of the boiler and cause a sintering of other dust on the heat surfaces, again making the removal of these adhered particles very difficult. Thus, as hot gases from the combustion process entrain burning fuel particles and carry them upwardly, these particles may reach super heater tubes 58 and steam generator tubes 60 and may be deposited thereon. These tubes 58, 60 are conventionally used in such boilers for the generation of super heated steam for use in producing electrical power or for providing heat for other processes. As burning carryover particles impact these tubes, a build-up in the form of deposits occurs and tends to plug the passages between the tubes. Such a build-up reduces the heat transfer efficiency to the tubes and the boiler capacity. These deposits may eventually cause a shut-down of the boiler and also contribute to boiler tube corrosion.

For maintaining clean heat transfer surfaces, including the surfaces of the tubes 58, 60, liquor recovery units are normally provided with a means for cleaning the heat transfer surfaces. Such soot removal devices typically consist of pipes through which steam is injected while the pipes are being moved through the boiler. Even with these cleaning mechanisms, it is often necessary to stop the operation of the boiler for cleaning purposes. This results in a loss of expensive pulp mill production time. In addition, these cleaning mechanisms are typically very effective at removing soft deposits on these tubes, but are much less effective in removing the hard deposits formed by burning carryover particles.

Information on kraft process chemical recovery furnaces of the type heretofore described is readily available, with three principal recovery boiler manufacturers being Combustion Engineering; Babcock and Wilcox; and Götaverken.

The boiler performance monitoring and control system of the present invention is indicated generally at 80. This apparatus includes a carryover particle monitoring subsection or mechanism indicated generally at 82, a bed profile determining section 84 which, in the illustrated embodiment, preferably includes a bed temperature determining section, and a data processing section 86. The data processing section 86 includes an Intel 80386 microprocessor based computer 90 with a math co-processor and a video processing card, such as a VFG card from Imaging Technology, Inc. of Wolburn, Mass., for processing the input signals.

More specifically, a carryover particle detector, and preferably plural such detectors, 96 (as described more fully below) detects carryover particles at an upper region of the furnace 10. Signals representing the detected carryover particles pass on a line 97 to an interface 98 and on a line 100 to the data processor 90. Processor 90 generates a carryover particle count indicative of the carryover particles detected by each of the detectors 96. Similarly, a camera system 110 collects video and temperature information from the furnace 10, with signals containing this information being transmitted on a line 112 to the data processor 90. Bed temperature and bed configuration information is determined from this latter information. As a result, the furnace monitoring system of the present invention provides simultaneous information concerning carryover particles, bed profile and related characteristics, and bed temperature, which is then processed for use by the operator of the furnace. A display, such as a conventional screen display or monitor 116, is provided for viewing a visual representation of the information determined by the system.

To provide more readily usable information, a common screen display of temperature, bed profile and carryover count related information is the preferred form of visual display. Such a common display is described below in greater detail in connection with FIG. 26. Also, a data input device, such as a keyboard 120, is included for use by the furnace operator in inputing data into the system of the present invention. For example, as explained below, information on the location of fixed features in the visual image (e.g. ports 16 and gun nozzles 32, 34), may be entered interactively by the furnace operator so that the effect of these features on bed profile determination may be minimized. The monitoring system of the present invention may be used directly in the control of the furnace or indirectly, such as through operator entered commands via the interface 120 or a conventional interface at the process computer 28. In either case, command signals may be transmitted on a line 122 and through a conventional sensor interface 124 to the data bus 40 and thus to the process computer 28.

To provide more complete information concerning the operation of the furnace, as previously mentioned, preferably plural detectors 96 are used. In addition, two or more of the camera systems 110 are also typically used.

Figure 2:
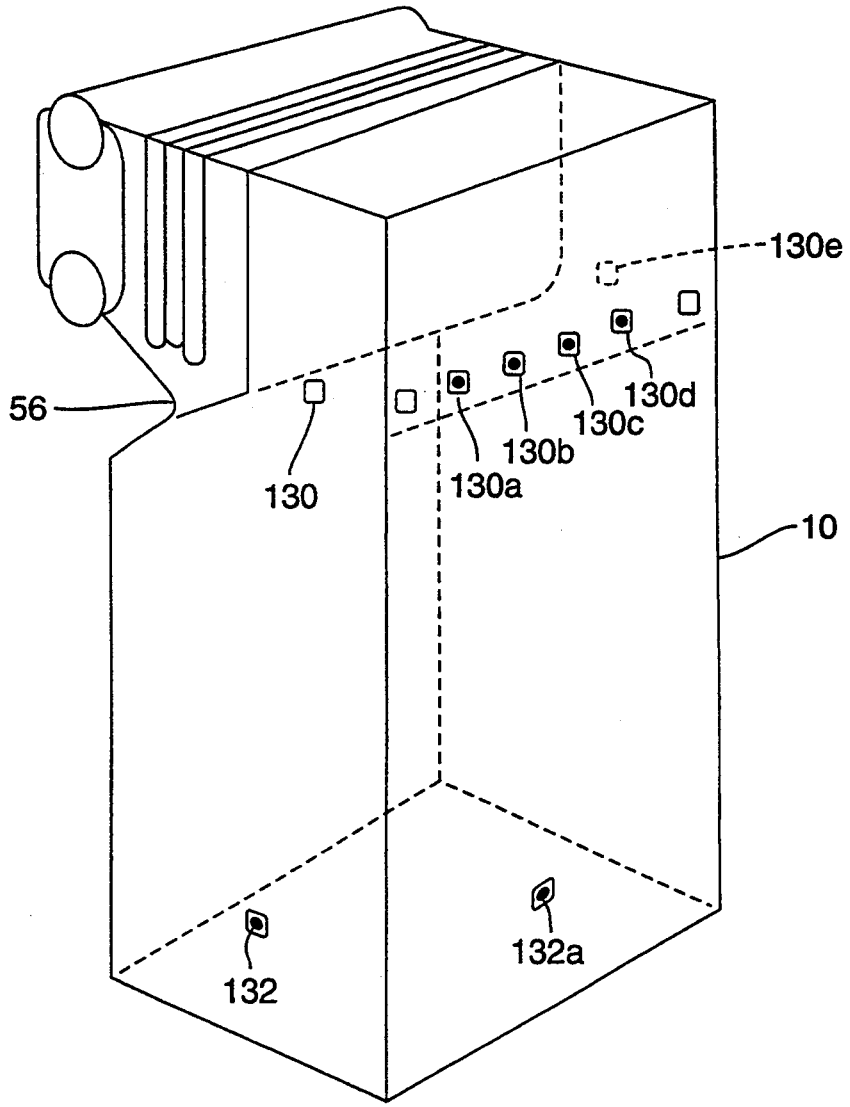
FIG. 2 is a schematic illustration of a recovery boiler showing exemplary monitoring sensor locations in accordance with the present invention.

Although variable, depending upon the type of furnace and number of detectors used, one preferred set of detector and camera locations is illustrated in FIG. 2. In particular, detectors 96 may be located at respective ports 130 through **130*e* at the sides and back of the furnace 10. Similarly, if two camera systems 110 are used, they may be positioned to gather information at locations 132 and 132*a* shown in FIG. 2** at one side and the back of the furnace, typically at the secondary air supply level. These detectors and cameras are positioned typically to gather information through existing ports in the furnace.

Figure 3:
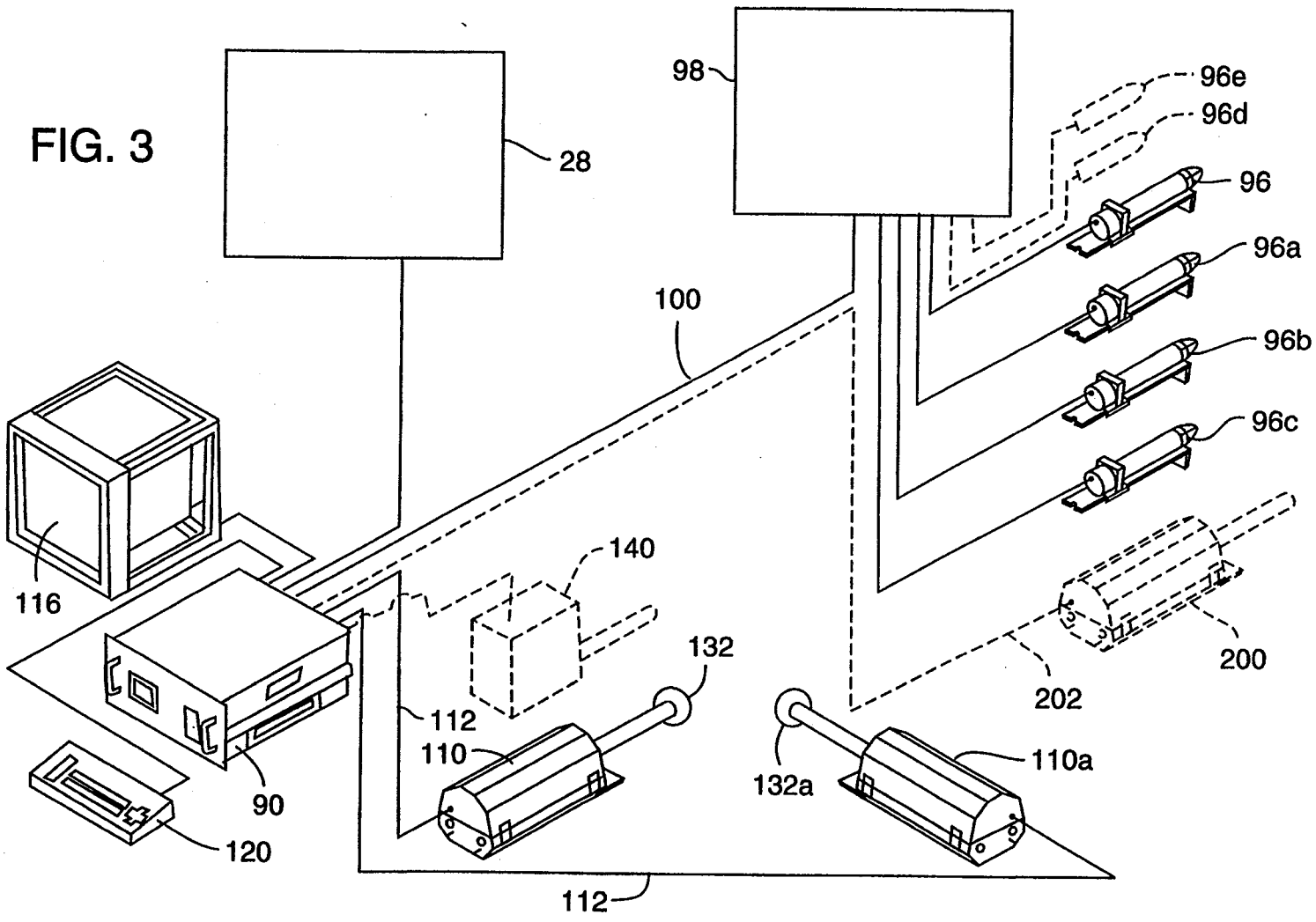
FIG. 3 is a schematic illustration showing one preferred arrangement of the bed profile and temperature monitors and the particle monitors of the present invention.

FIG. 3 illustrates in schematic form six detectors **96–96*e* and two camera systems 110, 110*a* which are utilized to obtain data from the detector and camera locations indicated in FIG. 2. FIG. 3 also indicates an optional camera 200 coupled by line 202 to the processor 90 for obtaining a visual indication of the carryover particles being detected by detectors 96 through 96*e* to confirm the accuracy of the detection. It has been found that such a camera 200 is typically eliminated as the detectors 96 through 96*e* provide a reliable means for detecting carryover particles. FIG. 3 also shows an optional pyrometer 140 for obtaining additional temperature information from the interior environment of the furnace. However, as explained in greater detail below, in the most preferred approach the temperature information is extracted from the signal being delivered by the camera systems 110, 110*a*** rather than from a pyrometer having a separate field of view from the field of view of the cameras. This approach eliminates errors which could otherwise arise from the need to match the pyrometer field of view to the camera field of view.

CARRYOVER PARTICLE DETECTION SUBSECTION

Figure 4:
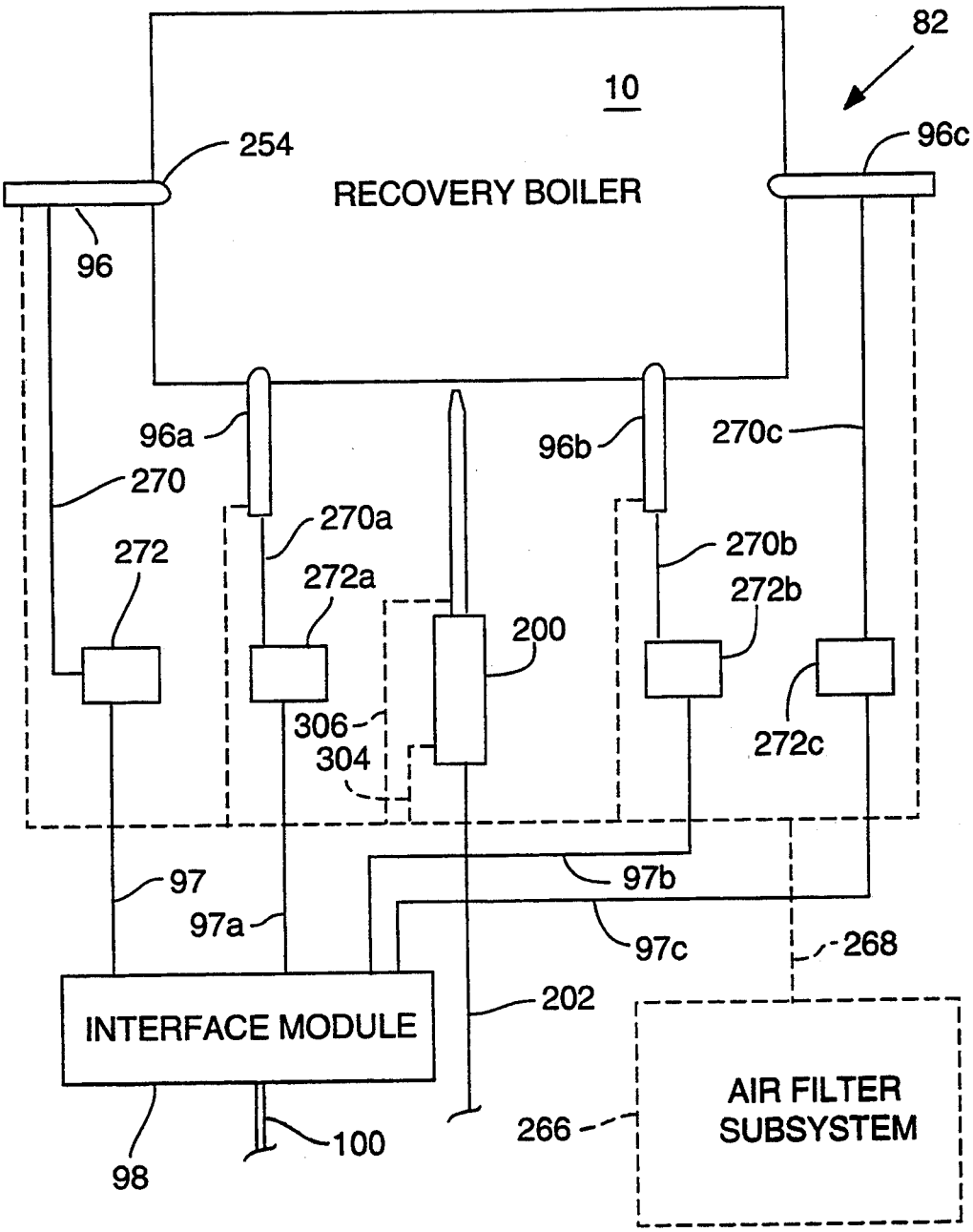
FIG. 4 is a schematic illustration of a particle detection apparatus included in the system of the present invention and having plural detectors positioned to detect particles at various locations in a recovery boiler.

With reference to FIGS. 1 and 4, one specific form of a carryover particle subsection 82 includes plural carryover particle detectors **96–96*c* (and may include more such detectors as shown in FIG. 2 or as otherwise desired. Each detector has an end 254 positioned, such as being inserted into an existing port of the furnace 10**, for monitoring a portion of the interior of the furnace. These detectors typically include a single point detector, such as a photo diode or other optical detection device. One example of such a detector is a UDT455 photo diode from United Detector Technology. The photo diode is positioned behind a lens for focusing the diode on a region of the furnace of interest. A single point detector, if used, has a number of advantages. For example, such a detector is symmetric in viewing a region of a furnace of interest so that its operation is independent of rotational variations, about the axis of the detector, and is therefore insensitive to such variations as the device is installed. Also, these detectors are equally sensitive to carryover particles traveling in planes perpendicular to the axis of the detector regardless of the direction of travel of carryover particles in such planes. The detectors are typically recessed within the ports about one to two inches from the edge of the port so that they do not project into the furnace where they may be impacted by carryover particles.

In FIG. 1, the detector 96 is shown positioned across from a "bull nose" section 56 of the furnace. However, the detectors may be positioned at any suitable location in an upper region of the furnace. In addition, the detectors may all be located in a single plane at distributed locations about the periphery of the walls of the furnace. Alternatively, or in combination, the detectors may be positioned to monitor portions of the interior of the furnace at different elevations, as indicated by the detector 96' in dashed lines in FIG. 1.

In accordance with the present invention, the detectors may be focused substantially at infinity. Due to the opaqueness of the gases typically found within the furnace 10, under these focusing conditions each detector typically focuses on a volume having a length ranging from 0 to about 4 feet away from the side wall of the furnace to which the detector is mounted. In such a case, the detectors do not distinguish between particles of a relatively small size which are close to the detector and particles which are of a relatively large size and which are further away from the detector. Alternatively, the detectors may be focused on a focal plane located closer to the side wall of the furnace than with the focus at an infinity focus setting. In this alternative case, depth of field carryover particle discrimination is possible. That is, under these conditions, carryover particles within a certain focal region or distance of the focal plane of a detector, for example within about plus or minus twenty percent of the distance from the wall of the furnace to the focal plane, are in focus and are thus detectable by the detector. In contrast, carryover particles which are closer to the detector than this distance and those which are farther away tend to be out of focus. Therefore, these signals may be ignored as background noise in the detector output signal. The inventors believe that improved detection results from a shift in the focal plane of the detectors to a distance which is at least about one foot from the adjacent side walls of the furnace because this tends to increase the volume of the furnace being sampled to provide a more representative carryover particle count.

An interface 98 couples the detector output signals to the data processor 90 (FIG. 1). The data processor produces a count signal corresponding to the count of carryover particles detected by the detectors. The detectors produce output signals which are markedly different upon the passage of a carryover particle within the region of the furnace being viewed by a detector. These detector output signals thus contain information on the occurrence of carryover particles. Information from the carryover count may then be displayed at display 116 alone or, more preferably, in conjunction with other information, or utilized in the control of parameters affecting the performance of the furnace. In particular, signals from the signal processor 90 to the process computer 28 for use in controlling the furnace.

For example, increases in particle count rates have been observed to occur in response to large rapid changes in boiler operating conditions. Also, there may be a correlation between the loading level or volume of the bed 30 and the quantity of carryover particles which is produced. Thus, upon the detection of an excessive carryover particle count, the process computer 28 may act by way of an interface (not shown) and the valve or damper controller 27 (FIG. 1) to control air dampers and fuel valves in an attempt to reduce the number of generated carryover particles. As one specific example, the air flow dampers may be opened to increase the air flow and combustion rate to reduce the size of the bed 30. As another specific example, assume that the process computer 28 has recently caused a change in the settings of a damper in a manner which produced an unacceptable increase in the carryover particle count rate. In response to the information on carryover particle count from the data processor 90, the process computer 28 may return this damper to its previous condition to minimize the generation of carryover particles.

With reference to FIG. 4, one embodiment of the carryover section 82 is shown in greater detail. In this case, four detectors 96, 96*a*, 96*b* and 96*c* are positioned at the same elevation of the furnace at spaced apart peripheral locations along three of the sides of the furnace. More or fewer detectors may be used as desired, and the detectors may also be located at varying elevations, such as shown in FIG. 1 for detector 96'. In one specific preferred approach, the detectors are in a plane at the "bull nose" level of the boiler at the sides of the boiler other than the "bull nose" side. In general, the detectors are positioned high enough in the furnace to detect burning or hot particles that are likely to still be burning when they reach the upper heat surfaces and tubes of the boiler.

A conventional air filter subsystem 266 filters air and delivers this air through purging lines 268 to the detectors for use in purging or sweeping the lens of each of the detectors. Such an air filter subsystem is also used in the previously described TIPS TM product available from Weyerhaeuser Company.

The output signal from detector 96, and more specifically in the illustrated embodiment from the detector diode, is preprocessed by circuitry at the detector 96, fed by a line 270 to additional preprocessing circuitry 272, and then by the line 97 to a commercially available computer interface module 98 as shown. Similarly, the outputs from detectors 96*a*, 96*b* and 96*c* are fed by way of respective lines 270*a*, 270*b* and 270*c* to associated preprocessing circuits 272*a*, 272*b* and 272*c* and then by respective lines 97*a*, 97*b* and 97*c* to the interface module. Suitable preprocessing circuits are described in greater detail in connection with FIGS. 5 and 6A–6C.

The interface module 98 converts the received signals to a suitable digital form for delivery over lines 100 to the processor 90. One suitable interface module is a TIPS TM 2000 interface module which is available from Weyerhaeuser Company.

The image processor 90 performs a number of operations on the count data received from the interface module. For example, the image processor typically sums or otherwise combines the results of the detector counts, which may again be expressed as count rates, from all of the detectors utilized in the system. Then, by way of display 116, the overall average carryover particle counts and trends in overall counts may be displayed. In addition, either alone or in combination with the display of the overall count information, the count from each of the detector locations, such as the four locations shown in FIG. 4, may also be individually displayed.

With this information, an operator of the boiler 10 may observe an increase in the overall count from all of the detectors. In addition, by then monitoring the individual display of the counts associated with each of the four individual detectors, the operator may determine whether the carryover particle count is increasing generally throughout the furnace or only at selected locations in the furnace. An indication that the carryover count increase is the result of a localized disturbance is implied from a disparate increase in the count from one of the detectors (e.g. 96*a*) in comparison to the count at the other detectors (e.g. 96, 96*b* and 96*c*). As explained below in connection with FIG. 26, a graphical display of the counts from the individual detectors may be provided so that the furnace operator can rapidly view the carryover particle characteristic.

In response to the count information, the boiler operator may enter a command, by way of interface 120 (FIG. 1), to the image processor 90 which is passed through to the process computer 28. This command results in an adjustment of the performance of the furnace, such as by controlling valve controller 27 to adjust the dampers or valves as previously explained. In addition, the system may operate automatically with count signals being directly sent to the process computer, which then determines an appropriate command in response to an increase or decrease in the carryover particle count.

The system of the present invention also facilitates the cross correlation of carryover particle counts to furnace operation parameters. For example, the TIPS TM system is capable of, among other tasks, limited monitoring of the temperature of the bed 30. By correlating temperature changes, or other information on furnace performance, with carryover particle counts, an optimum set of parameters for a particular furnace may be established which minimizes the production of carryover particles. The optimum set of parameters is typically a set of control settings (e.g. fuel flow rate, air flow rate, fuel viscosity, etc.) affecting furnace performance.

In accordance with the present invention, the apparatus may also include an optimal imaging sensor 200 (FIG. 4) focused on an interior region of the furnace for producing an image signal. This image signal is fed by a line 202 to the image processor 90 and may also be displayed at the display 116 or at another display (not shown). In a conventional manner, the imaging sensor 200 is also typically provided with a source of cooling and purging air, by way of conduits 304, 306, from the air filter subsystem 66. Although any suitable image sensor may be used, typical sensors include a charge coupled device (CCD) detector or a video camera system such as described in U.S. Pat. No. 4,539,588 to Ariessohn, et al. may also be used. The unprocessed image signal on line 202 from the image sensor is digitized by the image processor 90 and displayed. From this display, the boiler operator may observe the occurrence of carryover particles and compare the observed information to the determined count. This enables the boiler operator, for example, to obtain a visual confirmation of the occurrence of at least a portion of the carryover particles being counted by the carryover particle detection section 82. However, typically the image sensor 200 is eliminated because accurate carryover particle information is available from the detectors.

With reference to FIGS. 5 and 6A–6C, a suitable circuit for use in the carryover particle section 82 will be described. More specifically, light from the field of view of the detector 96, as indicated by arrow 310 in FIG. 5, passes through a small lens and through an optical filter (not shown) and falls upon an infrared photodetector 312. This detector 312 is connected in a photoconductive mode with an integral amplifier 313. The photo diode 312 produces a 0 volt output plus/-minus 0.001 volts when the photo diode is not receiving any light. The detector output on line 316 is fed to an optional gain control amplifier 318 with a gain adjustment potentiometer 320.

The average analog value of the signals in this specific circuit should not exceed plus/minus 7 volts relative to ground potential (0 volts). Peak voltages also should typically not exceed about 10 volts in this specific circuit. Optimum performance is typically achieved when the average analog values are about 2 to 3 volts above ground potential. The object of these settings is to avoid the saturations of the optical detector. The value of the analog output from the amplifier 313 is adjusted by replacing the optical filter with a higher or lower value to achieve these operating conditions.

Figure 6A:
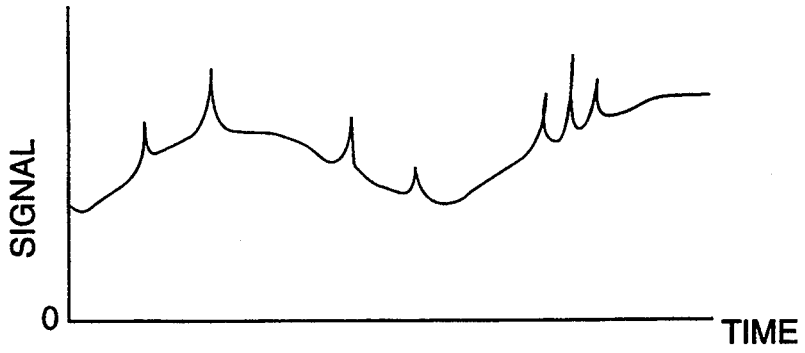
FIG. 6A, 6B, and 6C are illustrations of representative signals at selected points in the circuit of FIG. 5.

The signal from amplifier 318 is fed on a line 322 to a high pass filter 324. An exemplary signal on line 322 is shown at FIG. 6A and includes gradually varying background or noise signals, resulting from varying background light in the furnace, along with peaks indicative of the occurrence of carryover particles. The filter 324 minimizes the affect of these slowly varying background changes as indicated by the filtered signal shown in FIG. 6B. The filter typically comprises a 24 db per octave high pass filter, with a 3 db cut-off frequency of 3 Hz. This filter removes most of the background radiation from the detected signal.

The filter output is fed by a line 326 to a first input of a comparator 328. A reference voltage circuit 330 is coupled to the comparator 328 for providing a reference or threshold voltage signal for the comparator. As shown in FIG. 6B, the threshold level is adjusted to eliminate or minimize the effect of background noise on the detected carryover pulses. A typical threshold for this circuit is approximately 0.3 to 1.0 volts above the peak noise levels. The comparator illustrated in FIG. 5 outputs a logic "0" when the threshold, set by the threshold or level adjust potentiometer 330, is exceeded. When the signal drops below the threshold, the output of the comparator returns to logic "1". An exemplary inverted output from the comparator 328 is shown in FIG. 6c. The components described with reference to FIG. 5 to this point are typically packaged as a printed circuit board and included within the detector 96.

The comparator output appears on line 270 and is typically coupled to a circuit 272 on a circuit board which is spaced from the detectors. The components on circuit 272 are thus more isolated from the adverse heat and other environmental conditions associated with the furnace. The signal on line 270 is fed to a count detection input of a microprocessor 334. The pulses received on the input pin to the microprocessor are counted. Although a single microprocessor with plural inputs may be used for receiving the signals from all of the detectors, more typically a separate microprocessor is associated with each detector.

Figure 5:
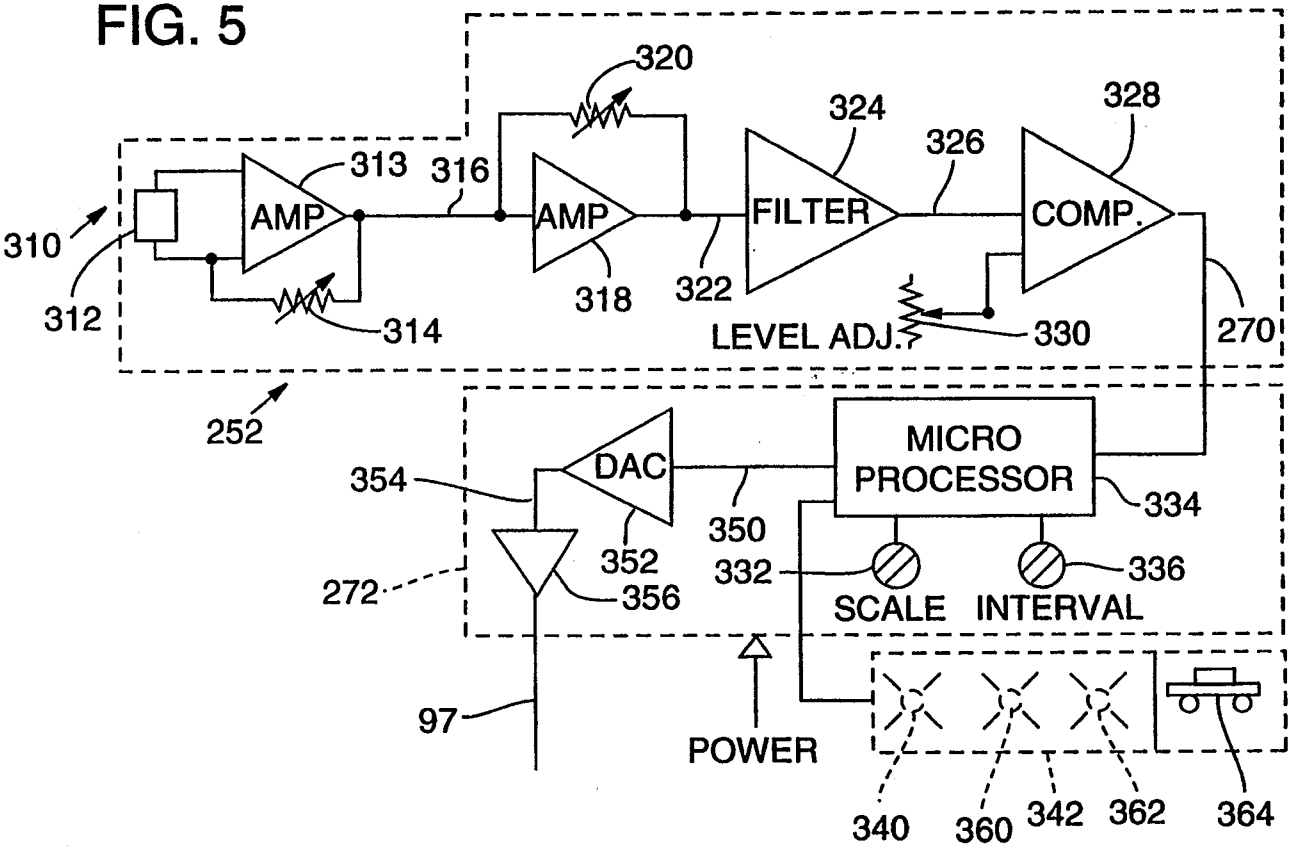
FIG. 5 is an electrical schematic diagram of one form of a circuit useable in conjunction with the detectors of, for example, FIG. 4.
Figure 6B:
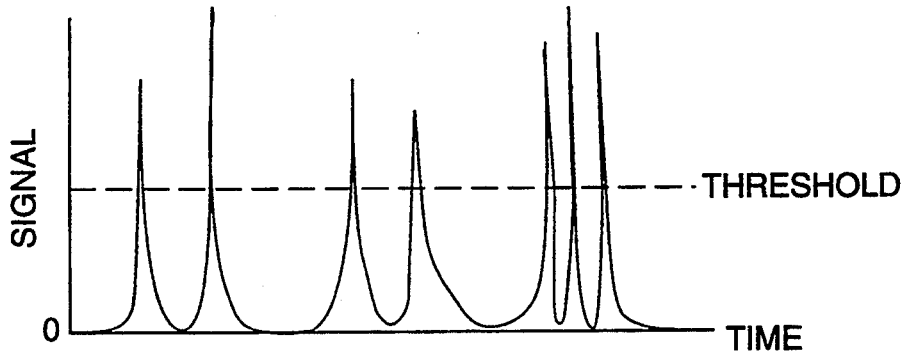
Figure 6C:
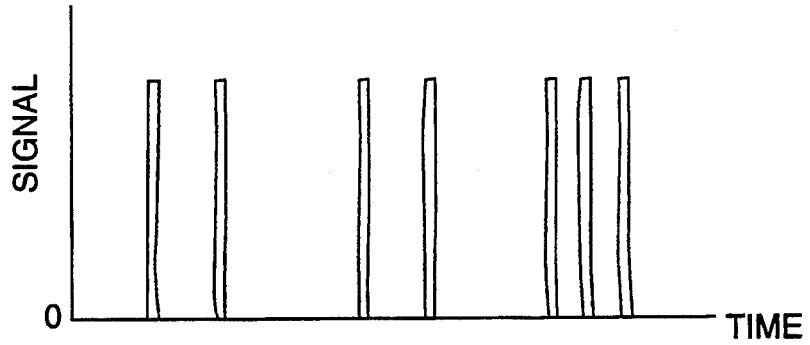

An interval switch, indicated at 336 in FIG. 5, may be used to establish a time interval over which carryover particles are counted. When the interval selected by this interval switch has ended, the carryover particle counter value and the interval setting may be read by a microprocessor scaling routine to provide count rate information on a per unit time basis. These time intervals may be repeated to provide counts on a per interval basis as well. Alternatively, the amount of time required for a specific number of counts to occur may be measured with the counts number and then being divided in the microprocessor by this measured time to produce a count rate. In general, when a count in the form of a count rate is desired, a mechanism is employed which produces a result expressed in units of counts per time. In the interval approach, the scaling routine divides the count value by the interval setting and uses a full scale setting (set by a scale switch 338) to create an 8-bit number. If the result exceeds 8-bits, an overflow indicator, such as an LED 340 on display board 342, is activated and the 8-bit value (or other count rate indicator) is set to 355, a full scale output. The 8-bit value is transmitted over a line 350 to a digital-to-analog converter 352. In addition, the digital-to-analog converter output is fed over a line 354 to a driver 356, such as a 1B21 optical isolating driver from Analog Devices. The output of driver 356, on line 97, is at a suitable level for delivery to the interface module 98 (FIG. 4). For example, in a typical pulp mill, signals at a 4 mA. level (corresponding to a zero output) and a 20 mA. level (corresponding to a full-scale output) are used. Another common mill scale range is from zero to 10 volts. For such mills, the output of driver 356 is adjusted for this latter scale.

A full-scale output occurs typically when the average number of detected carryover particles per second equals or exceeds the setting of the scale switch 338. For example, for a scale switch position of zero, the maximum average of detected carryover particles per second may be one; for a scale switch position of one, a maximum average of detected carryover particles per second may be two; for a scale switch position of two, the maximum average is five; for a scale switch position of three, the maximum average is ten; for a scale switch position of four, the maximum average is 20; for a scale switch position of five, the maximum average is 50; and for a scale switch position of six, the maximum average is 100. Also, typical time intervals established by interval switch 336 are respectively 1 second, 2 seconds, 5 seconds, 15 seconds, 30 seconds, 1 minute, 2 minutes, 5 minutes, and 15 minutes.

The interval switch 336 is typically eliminated by simply measuring the amount of time required to achieve a carryover particle count of a particular magnitude and dividing the count by the measured time. Also, the scale switch 338 is also typically eliminated by providing the microprocessor with a mechanism for compressing the scale. For example, by expressing the count rate on a logarithmic scale in the microprocessor, the count rate may be accommodated without the occurrence of an overload condition.

The display panel 342 may also include indicators 360, 362 for other purposes. For example, indicator 360 may comprise an LED or other visual or auditory indicator which is activated, for example, for 1/30th of a second, to indicate that a carryover particle has been detected. In addition, the indicator 362, such as an LED, may be used to indicate the end of each interval if a times interval approach is being used. Also, a reset switch 364 may be provided to reset the microprocessor to a zero count.

The information on carryover particle counts may be displayed with other information determined by the monitoring apparatus of the present invention for observation by an operator of the boiler to verify boiler performance. In addition, this information may also optionally be used in the control of parameters, such as fuel and air flow, affecting boiler performance.

BED PROFILER SECTION

The bed profiler section 84 will be described in connection with the application of monitoring the profile of a smelt bed of the recovery boiler 10. It should be noted, however, that the bed profiler section is also applicable to imaging the profiles of other types of beds and in particular to beds of the type which emit infrared radiation in environments which are obscured by particulate fumes and hot gases. Also, for purposes of convenience, the present invention will be described in connection with an imaging system of the type described in the Ariessohn, et al. patent, although other imaging devices will be suitable depending in part upon the nature of the furnace environment. For example, an arrangement of photo diodes may be utilized for this purpose. Thus, any system suitable for monitoring the bed of a furnace and generating an image signal corresponding to the bed and walls or other background surrounding the bed may be used.

Figure 7:
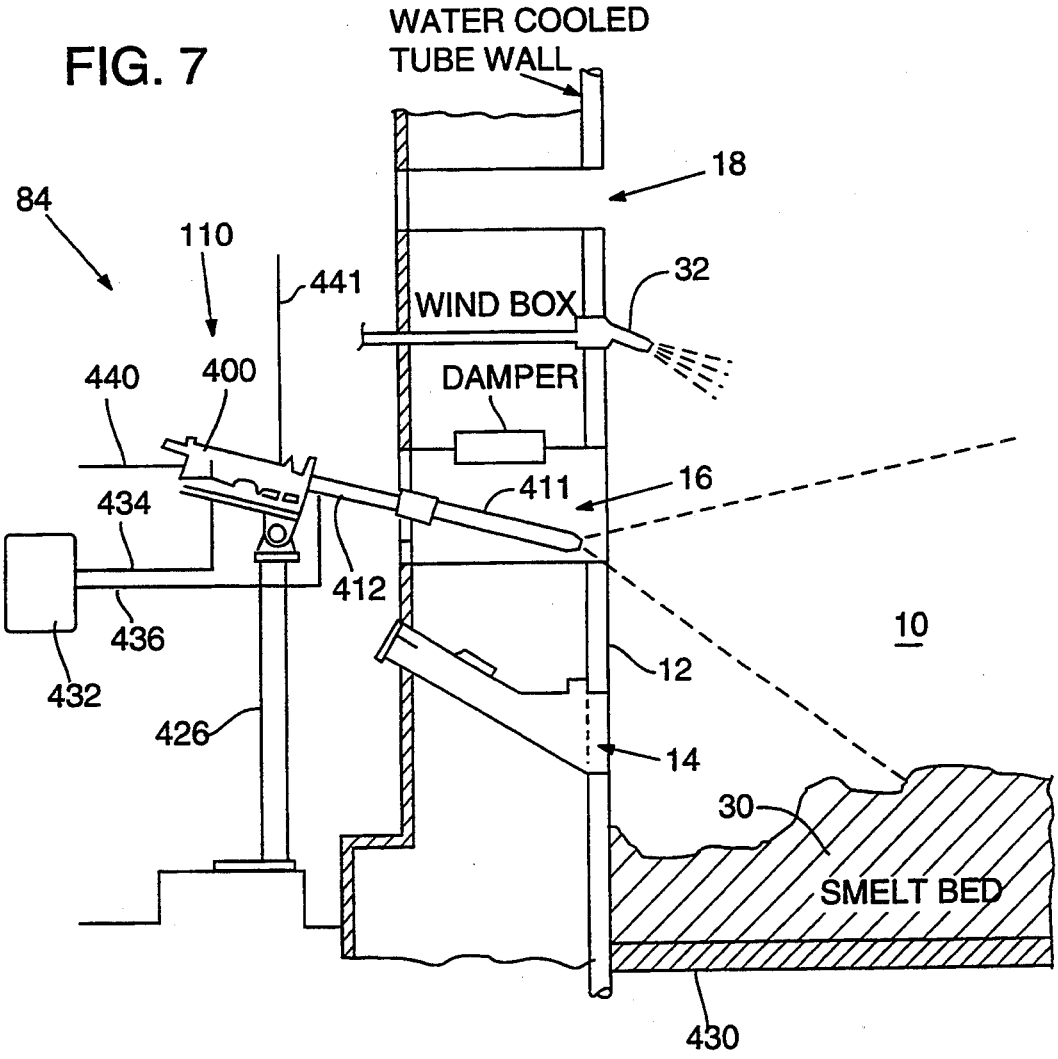
FIG. 7 is a schematic illustration of a bed profiler and temperature detection apparatus included in the system of the present invention.
Figure 8:
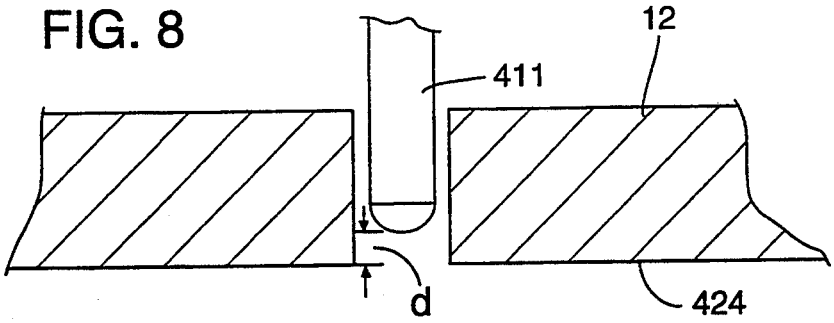
FIG. 8 is a cross-sectional view through a portion of a wall of the furnace of FIG. 7, illustrating the position of an imaging apparatus within a port extending through the furnace wall.

Referring to FIG. 7, the illustrated camera assembly 110 includes a closed circuit television camera 400 with an infrared vidicon tube component (not shown in detail) located adjacent a boiler 10 whose interior is to be imaged. A lens tube assembly 411, mounted upon camera 400, extends toward the boiler 10 through a port or aperture 16 in the boiler wall 12. As shown in FIG. 8, the lens tube assembly 411 is typically spaced a distance d from the interior surface 424 of the boiler wall 12. Typically, the distance d is approximately about one-half to one inch so as to protect the tube assembly 411 from burning particles traveling within the furnace. The lens assembly 411 contains such objective, collecting and collimating lenses (not shown in detail) as are conventionally necessary to transmit an image to be remotely reproduced from the object to be observed to the infrared vidicon of camera 400. The camera 400 is mounted on a stand 426 which permits horizontal and vertical adjustment to view a substantial portion of the boiler floor 430 and the smelt bed 30 accumulated thereon. Typically, the camera is directed so as to view the bed and a portion of the background walls behind the bed in the field of view of the camera. This background may equivalently include the gases and particulate matter above the bed in the event the furnace back wall is not visible.

An optical filter 412 is included in the camera system of FIG. 1 so as to limit the wavelength of light transmitted to the vidicon from the object to be imaged so as to minimize interferences caused by particulate and fumes overlaying the surface to be imaged. The optical filter 412 typically further limits the transmission of light from the surfaces to be imaged to a narrow band which avoids the light emissions of the principle species of hot gases overlaying the surface to be imaged. The selection of optical filters suitable for these purposes is described in greater detail in U.S. Pat. No. 4,539,588 to Ariessohn, et al. Filtered purging air from an air source 432 is delivered by way of lines 434 and 436 to the imaging sensor components for cooling purposes and for sweeping debris from the end of the tube assembly 411.

Typically, the vidicon tube assembly 411 is positioned in an existing air supply port to the furnace, such as in the secondary air port 16 indicated in FIG. 7. Furnaces of this type also typically include primary air ports directed toward a lower portion of the furnace bed and tertiary air ports positioned above the secondary air ports. In addition, the supply of air to ports at these various levels and various locations about the periphery of the furnace may be manually controllable or may be controllable by a process controller or computer in a conventional manner. Thus, the supply of combustion air may be increased or decreased to substantially any location of the smelt bed 30 to adjust the combustion occurring at such location. In addition, fuel, such as black liquor from a kraft pulping operation, may be delivered in a conventional manner through plural nozzles, one being indicated at 32 in FIG. 7, to the furnace. These nozzles are typically positioned between the secondary and tertiary air supply ports. The supply of fuel is also typically controllable by the process computer or controller. In general, by controlling parameters, such as the combustion air-to-fuel ratio, the viscosity of the fuel, the direction of the fuel nozzles, and the like, the burning of fuel in the furnace may be controlled to optimize furnace efficiency, the reduction of chemicals in the furnace, and the throughput or capacity of the furnace.

As in the case of the TIPS TM system from Weyerhaeuser Company, the image signal from the imaging sensor may be delivered on a line 440 to the image processor 90 (FIG. 1) for signal processing. In addition, temperature information may be obtained, as explained below, from the video information. Thus, a portion of the incoming signal to the camera 400 may be diverted along a line 441 for use in the temperature determinations. The processed signal may be fed to the display 116. The interface 120 also allows the furnace or boiler operator to input information into the imaging system. For example, the furnace operator may enter a desired target bed profile.

As explained in greater detail below, the imaging section 84 in combination with processor 90 produces a digital image of the bed and background from the image signal received by way of the line 440. The digital image is processed as explained in greater detail below to determine the transitions in the image which correspond to transitions between the bed and background and thereby to the boundary or profile of the bed. A bed characteristic may then be determined from the processed image. Examples of the bed characteristics of interest include the bed profile itself and bed area, the bed height, the slope of the bed, and the volume of the bed. Other examples include the peak height of the bed, which may be determined relative to a reference line; a top bar location; and the width of the top bar and the center of the top bar, all of which provide information concerning the bed configuration. The top bar location is set at a level below which a user identified portion of the bed area (e.g. 80 percent) is present. Establishing a top bar is a method of establishing a bed characteristic which ignores peaks in the bed profile. The imaging system 90 may simply cause this information to be displayed on the monitor 116. However, optionally, control signals representing the determined bed characteristics may be transmitted to the process computer 28 (FIG. 1) for use in directly controlling parameters, such as the fuel and air ratios, which affect the combustion of fuel in the bed and thus the bed characteristics. In addition, the operator of the furnace may, as a result of observing the determined characteristics displayed on monitor 116 or which are otherwise indicated to the operator, enter commands by way of the input device 120 or an input device at the process computer. These commands result in control signals being sent to the process computer for again controlling the parameters affecting the performance and bed characteristics of the furnace.

Figure 9:
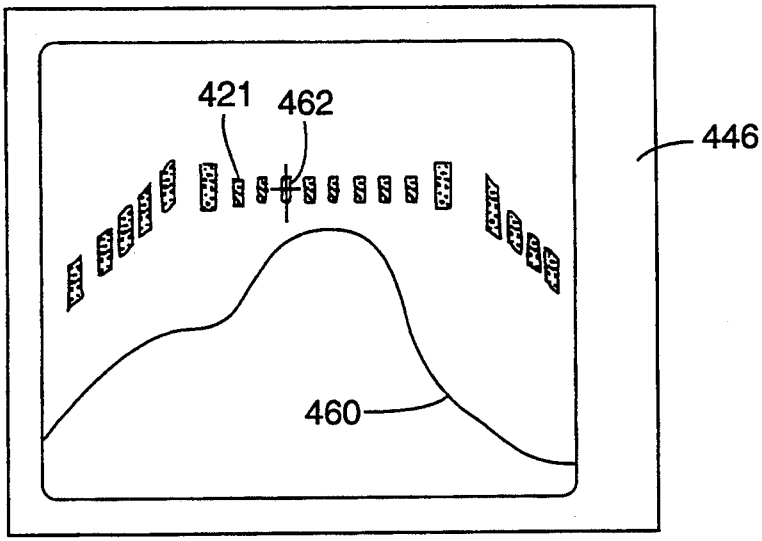
FIG. 9 is a display of a representative bed profile of a bed in the furnace.

With reference to FIG. 9, the monitor 116 is shown with a two-dimensional image of an actual bed profile 460 displayed thereon. The commercially available TIPS TM system is capable of producing video displays of bed profiles in this manner. Also shown in FIG. 9 is a reference pointer, such as a crosshair 462. Using the user input 120, the reference crosshair 462 may be shifted to overlay a fixed reference point in the furnace, such as one of the secondary air ports. Thus, when the image sensor 400 is in position, the bed monitoring is fixed relative to this reference. If at any time the crosshair is shifted from the reference, due to bumping or the like, the user of the device may readily observe this shift. The camera 400 may then be readjusted to its original position to again place the crosshair 462 over the original reference point in the furnace. Alternatively, the system may be recalibrated to a new reference point.

Figure 10:
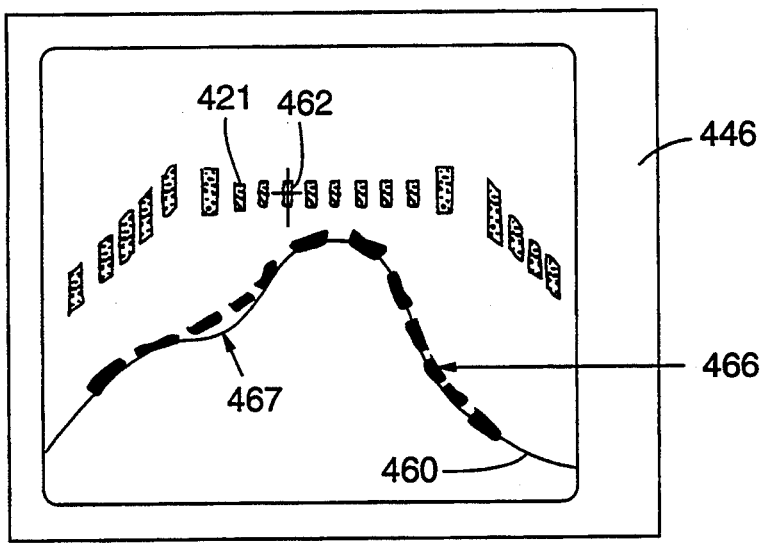
FIG. 10 is a display of the bed of FIG. 9 showing interposed on such bed a determined bed profile, determined in accordance with the apparatus and method of the present invention.

FIG. 10 illustrates a determined bed profile 466, in terms of a 12 line segment best fit, determined in accordance with the present invention. That is, as explained in greater detail below, the image produced by the imaging sensor or camera 400 is digitized and processed to determine the transitions in the image corresponding to the bed profile with the determined bed profile 466 being generated as a result of this process. In this example, the determined bed profile 466 is displayed for view by the operator. It is a non-trivial task to determine the profile from the video image due to the nature of the image. That is, an image of a bed of a furnace has fuzzy, blurred or otherwise indistinct transitions between the bed and the background. To digitally extract the transition points which define the bed profile, image processing techniques are used with the system looking for the soft or blurred transitions occurring between the bed and background under these adverse environmental conditions, such as in a kraft chemical recovery furnace.

Due to the nature of the transitions between the bed profile and background, an inexact fit may exist between the determined profile and the actual bed profile as indicated at 467. However, these differences are minimized utilizing the image processing techniques explained below.

Figure 11:
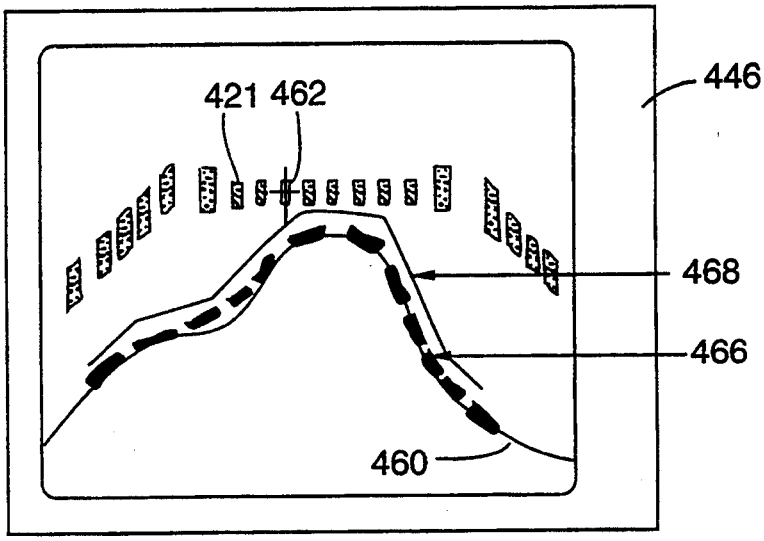
FIG. 11 is an illustration of the bed profile of FIG. 9 with the determined profile and target profile shown overlaid thereon.

FIG. 11 illustrates the bed profile 460 with the superimposed determined bed profile 466 and still another profile 468 included therein. The profile 468 corresponds to a target bed profile which may be entered by a user of the system utilizing input interface 120 (FIG. 1). This target profile may be provided for a given furnace, such as by a boiler manufacturer as a result of observations of a furnace. In addition to, or instead of, a target profile, other target bed characteristics may also be entered. For example, target maximum and minimum bed height, volume and slope data may be entered for comparison to corresponding characteristics determined from the image by the system of the present invention.

Figure 12:
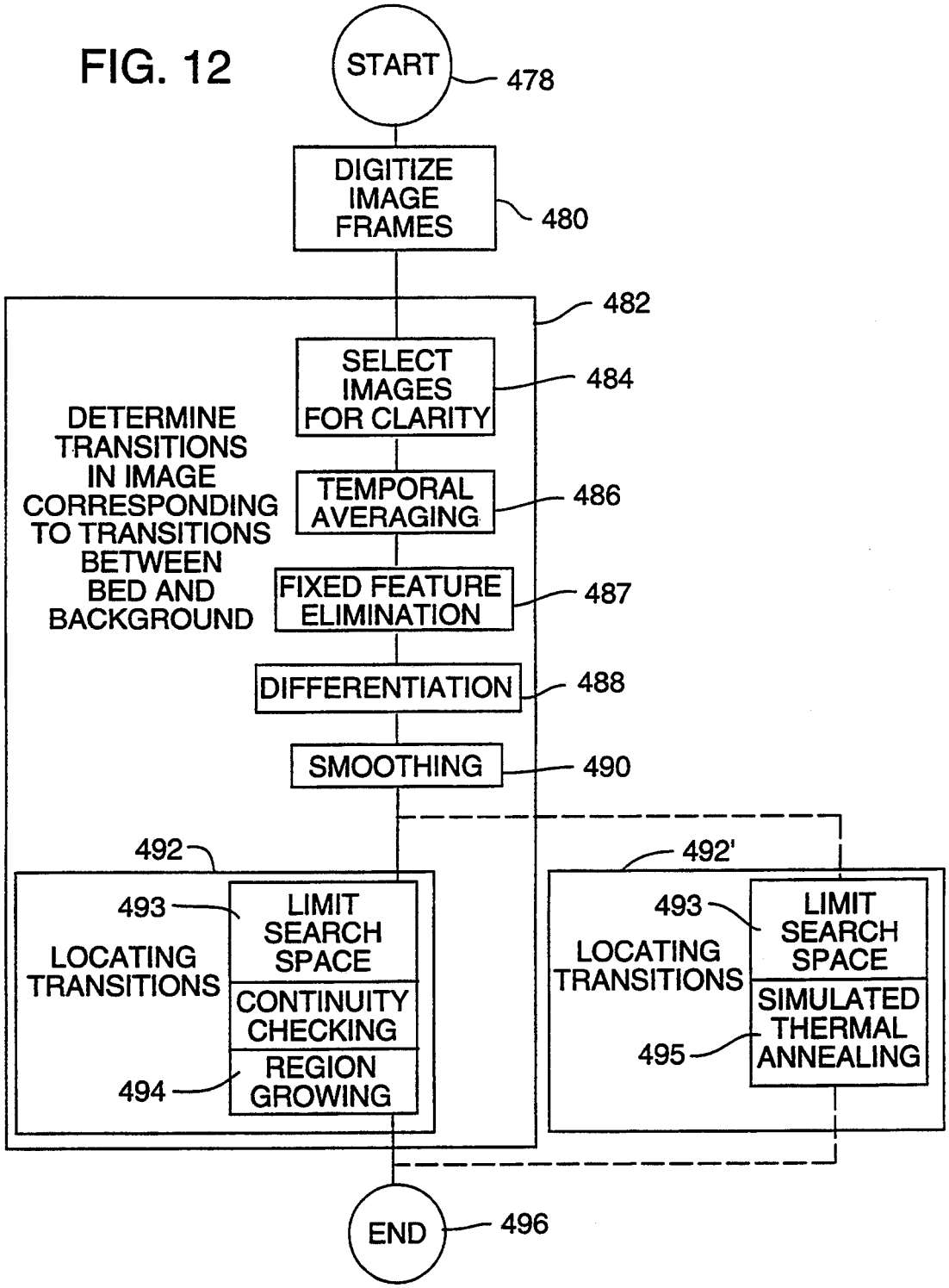
FIG. 12 is a flow chart illustrating one specific series of steps and several alternatives which may be utilized in accordance with the present invention to determine the bed profile of the bed being monitored.

With reference to FIG. 12, a preferred processing approach for determining the transitions between the background and bed, and thus the bed profile, is illustrated. From a start block 478, a block 480 is reached and corresponds to the digitization of image frames from the signal provided by image sensor or camera 400. This process is accomplished in a conventional manner on a frame-by-frame basis by the imaging system processor 90 (FIG. 1).

The digitized image frames are then used in the determination of the transitions in the image corresponding to the transitions between the bed and background as indicated at block 482. More specifically, this step typically is a multi-step image processing approach indicated by sub-blocks 484, 486, 487, 488, 490 and 492.

In accordance with one exemplary clarity selection approach at block 484, the images are selected based upon their standard deviation. First, a baseline standard deviation of intensities is calculated over a large number of images, along with the mean and the standard deviation of these values (that is, the mean and standard deviation of the standard deviations). Then, the images are monitored by the imaging system 90 and selected for further processing if the standard deviation of the image in question is larger than the sample average by one standard deviation. This provides an adaptive method for selecting relatively good images. Good images are those in which there is a high level of contrast in the intensities in the image. The image intensities vary for reasons such as flare ups in the bed, which may tend to obscure the boundary or profile of the bed. Typically, the block 484 process continues until eight images have been selected in this manner as having a clarity which is suitable for further processing. Of course, more or fewer images may be selected for processing as desired.

At block 486, a temporal averaging of the selected images is performed. That is, as another specific example, the selected images, in this case the eight images, are averaged pixel-by-pixel to filter out spurious and moving noise components. In a specific approach, the value of the pixel element at each location is summed with the other values of the pixel elements at the same location and the sum is then divided by the number of selected image frames to determine a temporal average.

Following block 486, in the preferred bed profiling approach, a fixed feature masking or elimination step is performed at block 407. Fixed features within the furnace 10 (FIG. 1), such as fuel guns 32, 34 and air supply ports (e.g. 16) often appear in the field of view of the camera 400 (FIG. 7). Due to intensity transitions in the digital image associated with these fixed features, unless masked, the fixed features can skew or introduce errors into the bed profile determination. Therefore, it is a desirable and preferred option to minimize the impact of fixed features in the analysis.

The illustrated exemplary fixed feature elimination portion of the profiler section 84 executes between the temporal averaging and differentiation phases. Fixed features are indicated by the furnace operator by moving a cursor on display 116 using input device 120 in a conventional manner to trace the fixed features. The processor 90 creates a linked list of pixels to locations corresponding to the locations on the linked list. The fixed features are then removed via pixel averaging from the composite image resulting from the temporal averaging step. The resulting image, with fixed features masked, is then further processed at block 488 as explained below.

Figure 20:
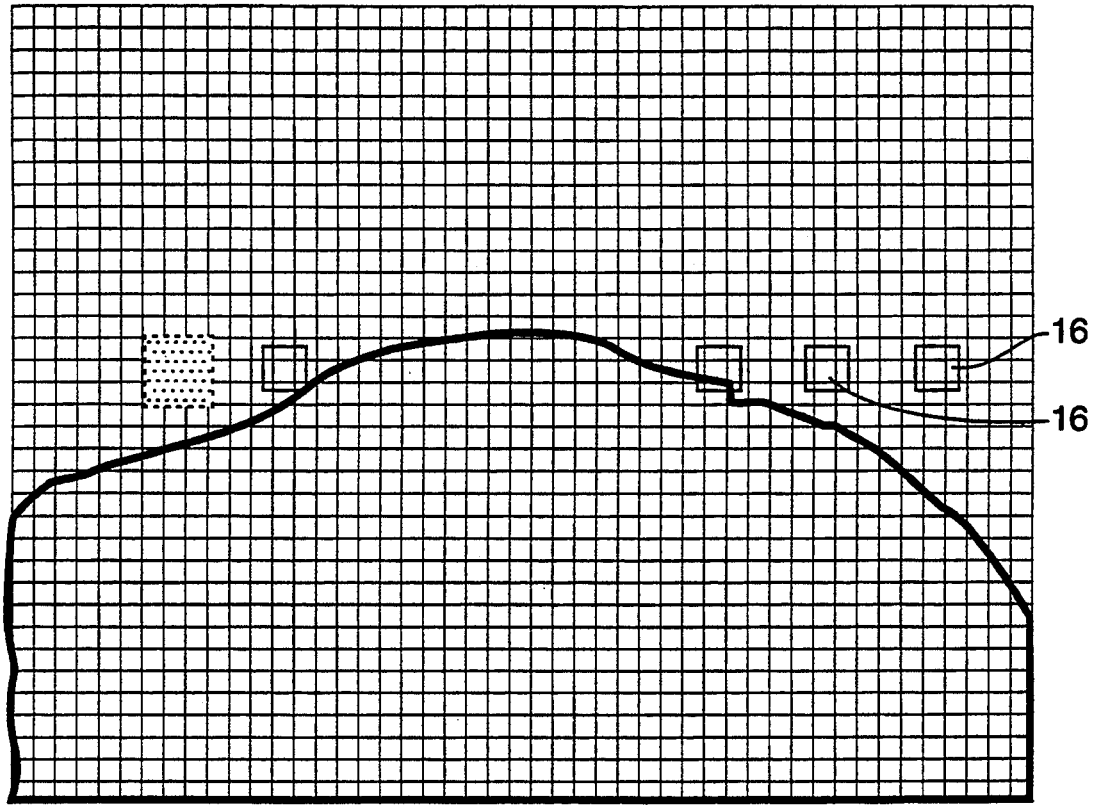
FIG. 20 is a schematic illustration of a smelt bed profile showing fixed features, a selected fixed feature, and an internal mapping of those features to a grid.
Figure 21:
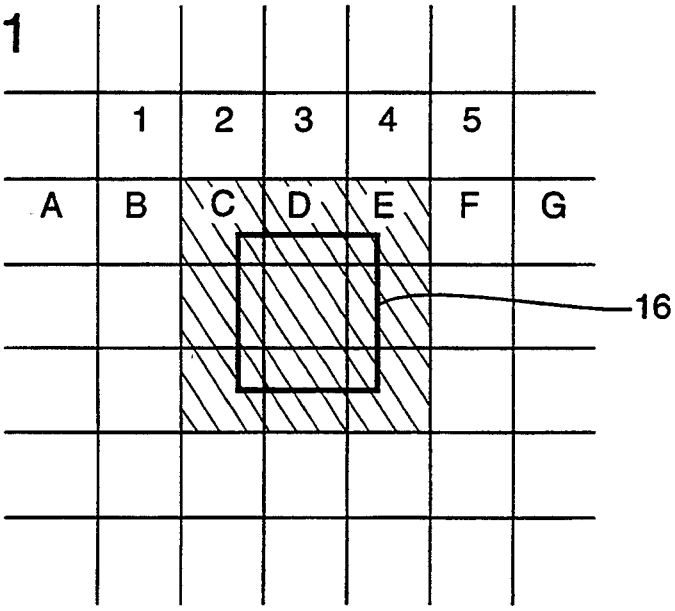
FIG. 21 is an enlargement of one portion of FIG. 20, including the selected fixed feature, and illustrates the masking or elimination of the selected fixed feature.
Figure 22:
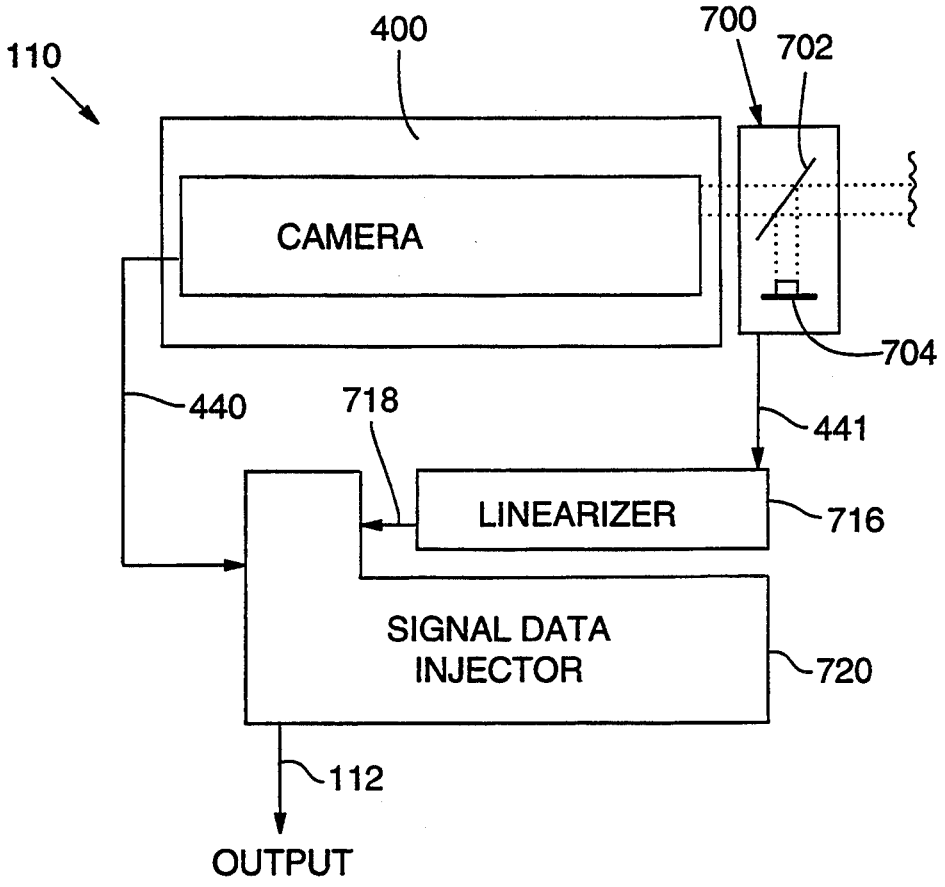
FIG. 22 is a schematic illustration of an imaging sensor including a beam splitting device and detector, and illustrating a bed temperature determining section in block diagram form.

To more fully explain this fixed feature elimination step, refer to FIG. 20, which illustrates a digital image of a bed and background with several ports 16 visible. The leftmost port has been marked by the user as a fixed feature, as indicated by the shading. In the illustrated approach, for purposes of fixed feature elimination, the overall image is internally subdivided into a mapped $64 \times 60$ segmented image. The segments or squares associated with this mapping are illustrated, for purposes of explanation, as being visible in FIGS. 20 and 21. The intensity for a particular segment is determined by averaging the intensity of the pixels in the segment. As is shown more clearly by the shading in FIG. 21, the port 16 is entirely covered, i.e. any square which contains any portion of the port is marked as part of the fixed feature. When all fixed features have been marked, their extents left to right are noted, and the results are loaded into the linked list.

Once the composite image is built in the temporal averaging phase, the linked list built at fixed feature entry time is traversed, and each feature stored in the list is replaced by an average of the intensities of its neighboring pixel values. Thus, in FIG. 20, pixels C, D, and E are replaced by the average of pixels A, B, F, G, and pixels 1–5. In cases where some of the pixels 1–5 or A, B, F, or G are part of other fixed features, those which are part of other fixed features are ignored. If all pixels to left and right, and above the feature are part of other fixed features or do not exist (as occurs in the case of an edge pixel), the fixed feature is not removed.

Of course, other fixed feature elimination techniques and, in particular, other intensity averaging approaches, may be used to accomplish the fixed feature masking. The goal of the above exemplary fixed feature elimination approach is to minimize transitions or image intensity differentials at the location of the fixed features so that the existence of these fixed features is masked as the digital signal is processed to determine the bed profile. Also, following bed profile determination, these fixed features may be reinserted into the image for display with the bed profile because their location is known from the linked list.

Thereafter, the processed images are differentiated, as indicated at block 488, to identify changes in local pixel intensity. In a specific differentiation approach, these changes in local pixel intensity are identified using an edge-detection convolution which tends to favor horizontally oriented edges. The desired convolution is empirically derived for each type of boiler selecting and refining a convolution until a suitable convolution is obtained for the particular boiler type. That is, the derived profile is compared with actually observed profile with the convolution being modified until a satisfactory match is observed repeated tests. A convolution mask $|M|$ for differentiation purposes which works well for a Götaverken-type boiler is set forth below:

$$\begin{vmatrix} -3 & -4 & -3 \\ -1 & -4 & -1 \\ 0 & 0 & 0 \\ 1 & 4 & 1 \\ 3 & 4 & 3 \end{vmatrix} = |M|$$

This convolution mask is applied to the pixels to obtain the differentiating image.

For example, to compute a new value for a pixel X8, one would apply the convolution mask above to the pixels surrounding pixel X8 in a conventional manner as expressed below.

$$\text{New X8} = \begin{vmatrix} X1 & X2 & X3 \\ X4 & X6 & X6 \\ X7 & X8 & X9 \\ X10 & X11 & X12 \\ X13 & X14 & X15 \end{vmatrix} X|M|$$

In the above expression, M stands for the convolution mask such as set forth above.

Because differentiation tends to amplify noise and create local spurious edge artifacts, a smoothing or blurring process may be utilized at block 490 to effectively remove small artifacts by averaging them with adjoining pixels. One specific smoothing approach involves an application of a smoothing convolution with a Gaussian kernel to the pixels.

Following the smoothing of the image, the transitions are then located as indicated at block 492. Several approaches may be utilized either alone or in combination with one another to locate these transitions. For example, continuity checking techniques may be applied and/or region growing techniques may be applied to locate the transitions. These steps are indicated at block 494 within the block 492.

The result of the differentiation is that pixels residing near edges become bright. If the back wall is not visible in an image, there tend to be more features which resemble edges in the bed than behind it. Conversely, where the back wall is of a greater visibility, more of the edges tend to be visible at the regions of the transitions between the bed and back wall.

A primary edge point or starting point for the profile may be determined by starting at the bottom of the image and looking for relatively bright pixels. Once a pixel is found with the highest position in the vertical direction that is relatively bright (relative to the other pixels in that vertical line), it is marked as the starting point.

Continuity is then enforced by, for example, a continuity checking technique. In accordance with this technique, for each edge element in question, continuity is checked for continuous edge elements to the right and to the left. If there are continuous pixels (that is, of a common intensity), indicating the probability of an edge, the pixel in question is forced to be near the midpoint between the left and right pixel segments. This process of continuity checking is performed recursively, and the result is that errors in the edge element selection process tend to be corrected. Thus, the continuity process involves imposing continuity on the determined profile and, alternatively, continuing this process to find the best fit of the pixels to a continuous profile from the starting pixel.

To further enhance the appearance of the determined profile, a subsequent smoothing or region growing process may be applied following the continuity checking or enforcement process. In accordance with the region growing approach, from a starting point, the mean and standard deviation is computed. The next point is then examined and evaluated to determine whether its intensity is close enough to the previous point to be part of the region. If so, it is included in the region and the mean and standard deviation is recomputed. This process is continued until a point can no longer be included in the region. This latter point is then identified and corresponds to an edge point of the bed profile. Typically, the region growing technique commences at a location which will be either above or below the bed profile with the region then being grown by adding pixels in the direction of the expected bed profile until a non-fitting point is identified.

The continuity imposition and region growing processes may be performed individually, but preferably collectively, to provide an enhanced determination of the bed profile. From block 492, the bed profile has been determined and the block 496 is reached.

As an alternative and preferable transition location procedure, a simulated annealing analogy may be applied to the image. This alternative is indicated in FIG. 12 by the dashed lines leading to block 492' and by the simulated thermal annealing block 495 set forth therein.

In this simulated Annealing approach, local conditional probabilities are used to model global properties of the differentiated image by quantifying relationships between neighboring pixels. In this way, multiple characteristics of a valid smelt bed edge can be made to add to or detract from the probability that any particular point in the image lies on the edge of the smelt bed. These characteristics include:

1) Strength of the edge: If a particular pixel in the image has a high gray value after differentiation, it is more likely to lie on the edge of the smelt bed.

2) Continuity: If a particular candidate point is close to neighboring candidate points on the left or the right (that is, if the point on the left is deemed to lie on the edge, and the point on the right is deemed to lie on the edge, and the neighboring points are close vertically to the point in question), then it is more likely that the point in question is on the smelt bed as well (since the edge is generally continuous).

3) Height: If a candidate point fulfills condition 1, above, and it is higher (towards the top of the screen) than other points vertically below it, it is more likely to be on the edge of the smelt bed (because features on the bed itself also show up on the differentiated image more than features on the wall).

4) Memory: Points which are not far from points chosen the last time the edge was found are more likely to be edge points since the smelt bed does not grow or shrink very quickly. The collection of vertical positions which maximize the overall probability (which is the sum of the local probabilities) is then the best choice for the edge of the smelt bed; that is, it is the choice which, given the differentiated image, has the highest probability of being the actual edge.

The problem then becomes efficiently searching for this collection of positions. Simulated Annealing is a method which does this by making an analogy to statistical physics in the formation of a crystal. These general techniques are described in greater detail in the articles: (1) "Optimization by Simulated Annealing", by Kirkpatrick, et al., *Science,* Vol. 220, No. 4598, pp. 671–680 (May 1983), Additional background; and (2) "Stochastic Relaxation, Gibbs Distributions, and the Bayesian Restoration of Images" by Geman et al *IEEE Transactions on Pattern Analysis and Machine Intelligence,* Vol. PAM 1-6, No. 6, pp. 720–741 (1984); both of which are incorporated herein by reference. First, probability distributions are calculated along vertical slices of the image (each slice being one pixel wide), which are the local probabilities that any particular point lies on the edge of the smelt bed. The distribution is according to the following equation:

$$P_h(P_v) = \frac{e^{\frac{-U_v}{T_t}}}{Z_n}$$

Where:

h=horizontal coordinate of slice $P_v$=point in slice at vertical location v $T_t$ is T at time t $Z_n = \Sigma_v P_h$ Where $U_v$ incorporates the local characteristics of a valid edge point in the following way:

$$U_v = \sum_{i=1}^{4} V_i$$

(Strength)

-continued $$V_1 = -D^* \frac{g(P_v)}{gmax_h}$$

Where:
D=data weight
$g(P_v)$=gray-value of $P_v$
$gmax_h$=maximum gray-value in slice h (Continuity)

$$V_2 = \begin{cases} -C^* \dfrac{(1 - \sqrt{(v - v_{h-1})^2 + (v - v_{h+1})^2}}{\frac{1}{6} V\max} \\ \text{or } O \text{ if } V_2 > O \end{cases}$$

Where:
C=continuity weight
V=vertical coordinate of $P_v$
$V_{h-1}$=vertical coordinate of slice h−1
$V_{h+1}$=vertical coordinate of slice h+1
$V_{max}$=length of slice (Height)

$$V_3 = \frac{-H^*(V_{MINh} - V + 2)^* g(P_v)}{V_{MAX}^* g_{MAXh}}$$

Where:
H=height weight
$V_{min\ h}$=bottom of slice
V=vertical coordinate of point in question
$g(P_v)$=gray-value of $P_v$
$V_{max}$=length of slice
$g_{max\ h}$=maximum gray-value in slice h (Memory)

$$V_4 = \begin{cases} O \text{ if } P_{h'} - V > 3 \\ -M \text{ OTHERWISE} \end{cases}$$

Where:
$P_h'$=vertical location of chosen point for previously calculated profile
V=vertical coordinate of point in question
For Götaverken boilers:
D=350; C=300; H=200; M=100

T acts like temperature in the physical analogy, in that when T is high, the probability distribution along a vertical slice of the image is essentially uniform. This distribution is sampled, and the result is the candidate position for that slice; it is stored and used in the calculation of neighboring vertical slices (for proximity). Calculations proceed vertical slice by vertical slice, until the whole image has been updated. Then, T is decreased slightly. This has the effect of making the distributions along each vertical slice slightly less uniform. The image is updated as before, and the process is repeated. As T decreases, the modes of the distributions become more and more exaggerated, and therefore the result of the sampling becomes less and less random. Given enough steps and the appropriate choice of starting T ($T_0$), as T approaches zero the global probability will reach a maximum as the "system" defined by the calculations will avoid local maxima.

In theory, it has been shown that the number of steps to insure the global maximum is prohibitively large. However, it has been determined empirically that with a choice of $T_0$=150 in the formula above, a relatively small number of steps (30, in this case) works acceptably for this application.

The algorithm can be tuned by varying the weights shown above. For Götaverken-class boilers controlled with the typical European strategy (in which large smelt beds are maintained), the weights shown above have proven to work well. For boilers in which the back wall is more visible, and the edge of the smelt bed is more distinct, such as Combustion Engineering-type boilers controlled with the typical North-American strategy, the following weights have proven effective:
D=400; C=350; H=100; M=100

The Simulated Annealing approach has proven to be an effective technique for use in bed profile determinations. From block 492, following this determination of bed profile, the block 496 is again reached.

The bed profile determining process has been further improved as indicated at blocks 493 in FIG. 6 by limiting the scope of pixels eligible for determinations as a boundary point of a bed. That is, since smelt beds do not tend to change radically from one calculation to the next, and since the edge can be reset if it encounters difficulties, it has been found that the limitation poses no significant problem in terms of reliability. Therefore, rather than evaluating all of the pixel at a given location. This option speeds up the transition determination computations. As a specific example, one can limit each distribution of pixels being evaluated to those which are a certain number of points or pixels above and below the last calculated edge for each horizontal position. In this way, a band or envelope is defined after each edge determination which limits the extent of searching for the next edge. With this limitation, the process also realizes a factor of 2 or 3 gain in the signal-to-noise ratio, as well as a reduction by the same amount in the calculation time. For Götaverken class boilers, it has been empirically determined that ¼th of the total vertical distance of the screen above and below the last calculated profile is effective. This number can be changed as well; in general, it is increased if there are typically large variations in the smelt bed over time, and decreased in very noisy images or when the smelt bed is indistinct for some reason.

Figure 13:
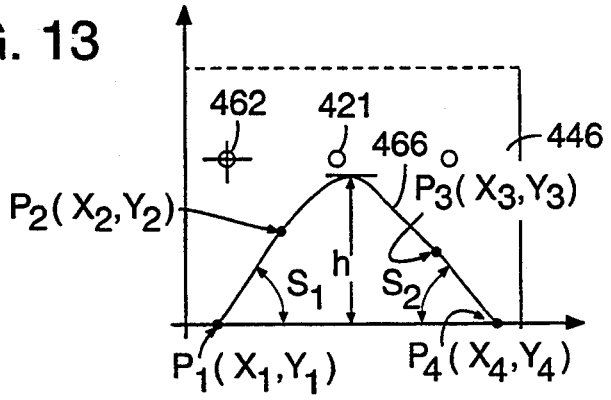
FIG. 13 is a schematic illustration of the field of view of a bed being monitored by an imaging apparatus to schematically show a determined bed profile and certain characteristics of the bed profile.

FIG. 13 illustrates a determined bed profile 466 which may be displayed on the monitor 116 (FIG. 1) for observation by the operator of the furnace. From the profile, a number of bed characteristics can be determined, such as the peak bed height indicated at h in FIG. 13. In addition, the bed volume may be computed from this profile, such as explained below. Also, the area of the projected two dimensional image of the bed may be computed. In addition, with reference to FIG. 26, a top bar may be located, and its width and center determined. Furthermore, a slope at various locations along the bed profile may also be determined. For example, the left hand slopes S1 may be determined by fitting a straight line to the profile points ($X_1$, $Y_1$) and ($X_2$, $Y_2$). As a simplified example, assume that there are no profile points between points $P_1$ and $P_2$ and between points $P_3$ and $P_4$. In this case, a (cartesian or (X, Y) coordinate system may be imposed on the field of view or display of the monitor 46. Respective points P1, P2, P3 and P4 (along with other points) may be identified by their respective X and Y coordinates along the bed profile. Slopes can then be determined in a conventional manner. For example, the slope at S1 may be determined as follows:

$$S1 = \frac{(Y_2 - Y_1)}{(X_2 - X_1)}$$

Similarly, the slope $2 may be determined as follows:

$$S2 = \frac{(Y_4 - Y_3)}{(X_4 - X_3)}$$

Figure 14:
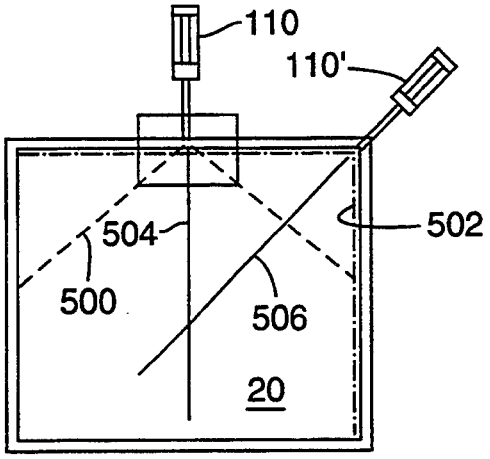
FIG. 14 is a top plan view of a section of a furnace with two imaging sensors shown therein for obtaining different fields of view of the bed of the furnace.

FIG. 14 illustrates a top plan view of the boiler 20 with two imaging sensors 110, 110' illustrated in this figure. The first imaging sensor 110 has a field of view indicated by dashed lines 500 while the second imaging sensor 110' has a field of view indicated by the dashed and dotted lines 502. Imaging sensor 110 is thus directed along a line 504 bisecting its field of view while imaging sensor 110' is thus directed along a line 506 which bisects its field of view. The lines 504 and 506 may be orthogonal or otherwise positioned relative to one another, but are illustrated to intersect at an angle $\beta$. The two imaging sensors may be utilized in connection with computing the volume of the bed as explained below. In general, for operations in which the boiler interior 10 is substantially opaque due to fumes and particulate matter, the angle $\beta$ is increased from an acute angle to an obtuse angle and may be set at a substantial angle such that the two lines 104 and 106 are approximately orthogonal to one another. The resulting image information provides a more accurate basis for determining of the volume of the bed.

Figure 15:
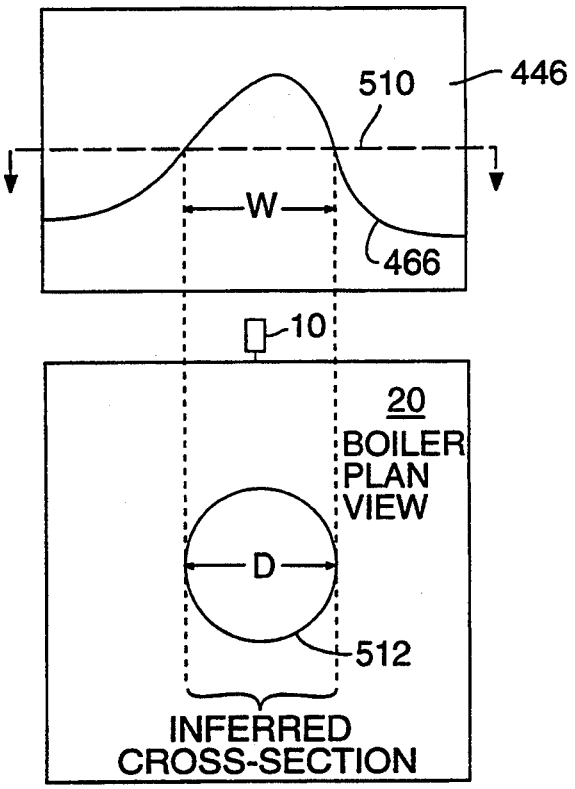
FIG. 15 is a schematic illustration of a determined bed profile obtained by using the image from one of the imaging sensors of FIG. 14 and further illustrating a circular approximation technique for determining the bed volume and the determined bed profile.

With reference to FIG. 15, a single imaging sensor 110 is shown and is used as explained above to produce a determined bed profile 466. Using a circular or other approximation for the contour of the bed, the smelt bed volume may be estimated or computed from the profile. That is, one can infer that a slice across the bed, for example, in a horizontal plane 510 as indicated in FIG. 15, yields a circular cross-section as indicated at 512 in FIG. 15. The inferred diameter D of the cross-section 512 is obtained from the width W of the determined bed profile at the vertical height of the horizontal plane 510. By integrating the profile, that is by assuming the profile defines a bed of circular rings stacked on one another, a bed volume may be computed.

Figure 16:
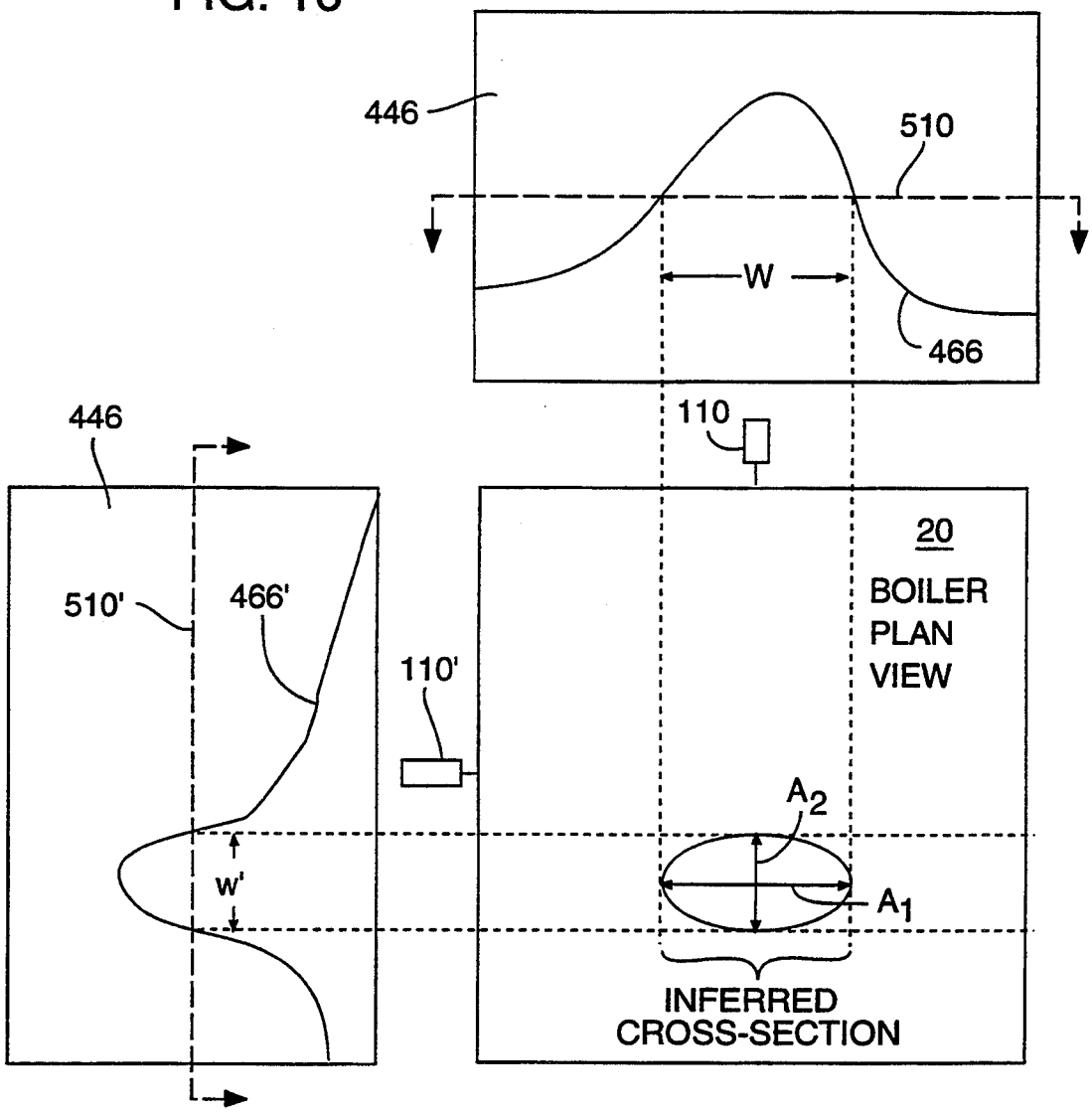
FIG. 16 is a schematic illustration of first and second determined bed profiles obtained by using the images from first and second imaging sensors of FIG. 14 and also illustrating an elliptical approximation technique for determining the bed volume from these determined bed profiles.

In FIG. 16, another approach for computing bed volume is illustrated wherein plural, in this case two, imaging sensors are utilized. That is, in FIG. 16, first and second imaging sensors 110, 110' are arranged as shown so as to be focused in directions orthogonal to one another. That is, referring again to FIG. 14, if one were to draw the lines 504 and 506 shown in FIG. 14, the angle $\beta$ would be 90°. In this case, from camera 110, as explained previously in connection with FIG. 15, an inferred width W of the bed in a first direction is obtained and is indicated by axis $A_1$ in FIG. 16. Similarly, the imaging sensor 110' produces a determined profile 466' from the view of the bed taken in the direction as shown in this figure. In a plane corresponding to 510, namely plane 510', a width W' is determined from the derived profile 466'. The inferred cross-section of the bed in this direction is indicated as axis $A_2$ in FIG. 10. Using an elliptical approximation for the bed, that is assuming $A_1$ corresponds to the length of an axis of an ellipse in a first direction and that $A_2$ corresponds to the length of an axis of an ellipse in the second direction, one can infer that the bed has an elliptical cross section. Integrating the bed over its height and assuming an elliptical profile, a computed bed volume may be obtained. Since beds are not necessarily symmetrical, a bed volume approximation utilizing plural image sensors will result in a more accurate bed volume computation.

Referring to FIG. 1, the bed profile imaging section, including the processor 90, may be used in the control of a furnace either indirectly, through operator entered commands via interface 120 in FIG. 1, or directly and automatically.

In a conventional smelt bed boiler, combustion air flow may be controlled between primary, secondary and sometimes tertiary ports to achieve a vertical air flow balance. In addition, air flow may be controlled to the various ports at each level individually to achieve a horizontal balance, with more or less air being supplied to various ports depending upon the performance of the furnace. In addition, the air flow may be controlled to achieve an overall balance in the system. In general, a number of parameters affect the performance of a furnace. In particular, a decrease in bed volume typically may be achieved by increasing the air-to-fuel ratio. In addition, to decrease the height of the bed, the flow of combustion air directed toward the upper sections of the bed may be increased. Conversely, to increase the height of the bed, the air supply to the upper region of the bed, e.g. by way of the secondary ports, may be reduced. Similarly, the slope of the bed may be varied by increasing or decreasing the air supplied to the respective lower and upper portions of the bed. That is, by decreasing the flow of air to a lower portion of the bed, the slope of the bed tends to flatten as combustion is typically reduced at such bed locations. Similarly, if a bed becomes tilted to one side, as would be apparent from the determined bed profile, combustion can be adjusted by altering the air supply to the respective sides of the bed to thereby adjust the contour of the bed.

Typically, an experienced boiler operator may observe the determined profile and, in response thereto, adjust the parameters affecting furnace performance to change the operating conditions of the furnace and thus the configuration of the actual bed. The determined bed profile will in turn be adjusted over time and the display of the adjusted determined bed profile will provide the operator with a confirmation of the success of the steps taken by the operator. In addition, by displaying a target bed profile along with the determined bed profile, an operator has immediate visual feedback as to a comparison between the determined profile and target profile so that the operator can readily determine differences or deviations from the desired result. Similarly, comparisons between target bed characteristics such as height, volume and slope may be displayed and compared with the corresponding determined bed characteristics. Furthermore, the system 80 (FIG. 1) may issue or produce an indicator signal in the event the difference between the target bed characteristic and the determined bed characteristic exceeds a threshold. For example, if the determined height of the bed exceeds the target height of the bed by a predetermined amount, for example about 20 percent, the indicator signal may be produced. The indicator signal may be fed to a visual indicator, such as an LED display. Alternatively, or in combination therewith, the indicator signal may be fed to an auditory indicator, such as an alarm. The visual and auditory indicators are activated to provide the operator with further information concerning the existence of undesirable conditions in the furnace.

Figure 17:
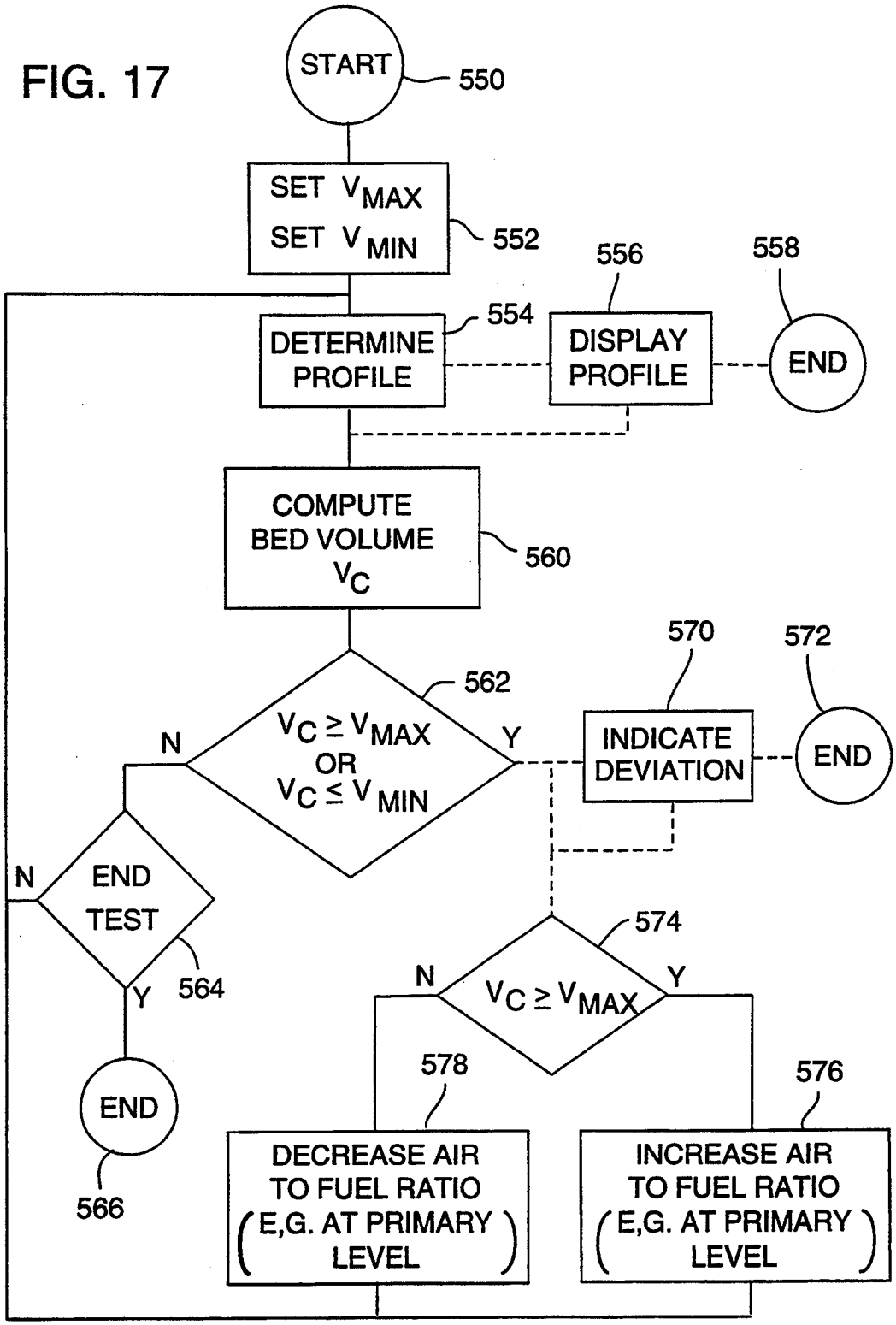
FIG. 17 is a flow chart illustrating the use of the determined bed profile information in determining the volume characteristic of the bed and optionally in the control of the furnace in response to the determined bed volume.
Figure 18:
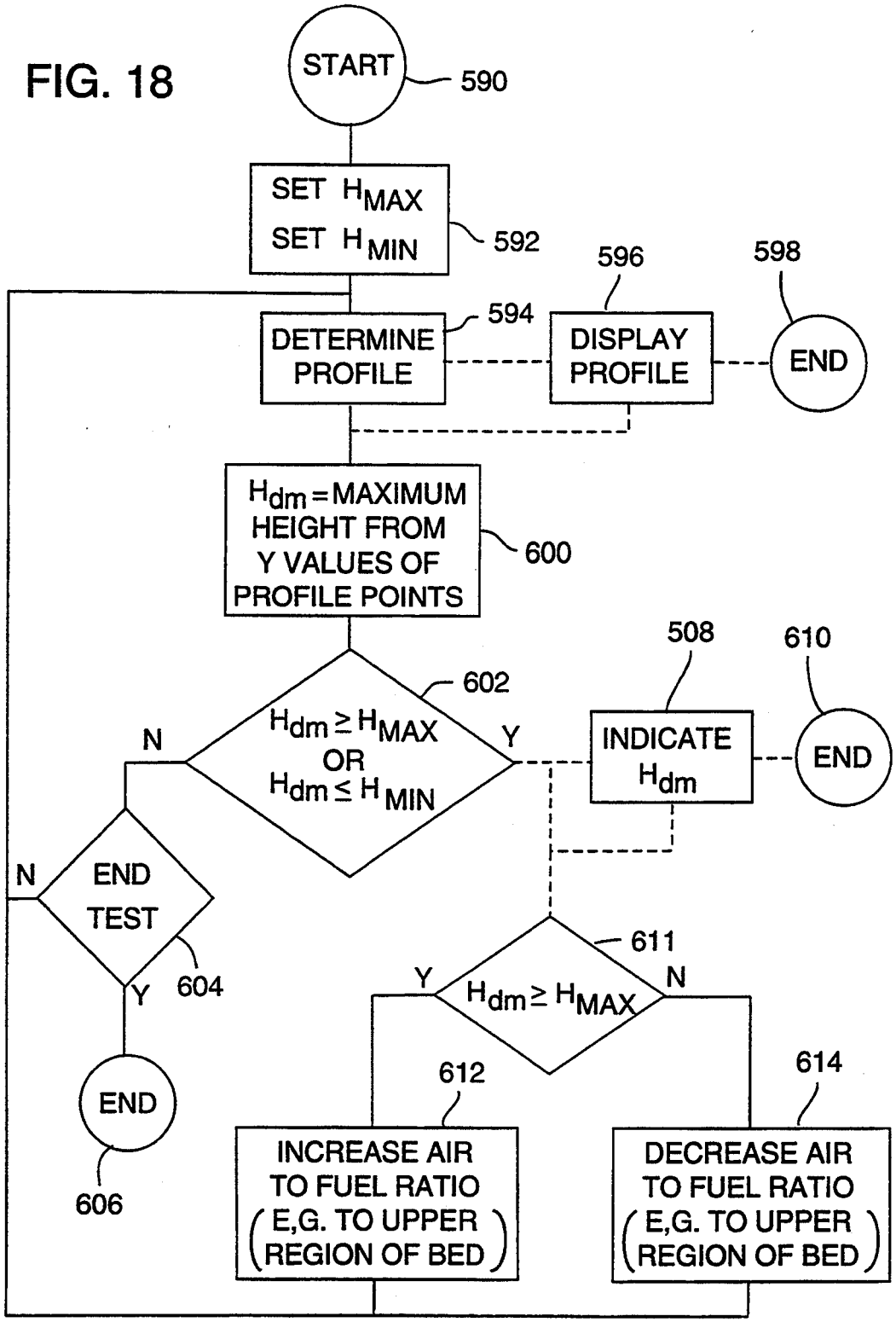
FIG. 18 is a flow chart illustrating the use of the determined bed profile information in determining the height characteristic of the bed and the optional use of the determined height information in the control of the operation of the furnace.

FIGS. 17, 18 and 19 illustrate exemplary flow charts used in processor 90 for processing the determined profile information.

With reference to FIG. 17, this flow chart relates to the display of information concerning the volume of the bed and use of this information in controlling the operation of the furnace. The flow chart starts at block 550 and then reaches a block 552 at which a maximum target volume Vmax and minimum target volume Vmin values are set. That is, at block 552, target maximum and minimum volumes are established for use by the system. At block 554, the profile of the bed is determined as explained previously in connection with FIG. 12. The determined profile may be displayed at block 556 with the process ending at a block 558 as shown in this figure (or returning to block 554 for continued processing). Alternatively, from block 556, or directly from the block 554, a block 560 is reached. At block 560, the bed volume is computed, for example using the circular or elliptical approximation techniques previously explained. The computed volume Vc is then compared at block 562 with the Vmax and Vmin volumes. If Vc is greater than or equal to Vmax or Vc is less than or equal to Vmin, a determination has been made that Vc, the computed volume, is outside of the target volume set at block 552. Otherwise, the computed volume is within the target and a branch is followed to a block 564. At block 564 a determination is made as to whether the testing is finished, in which case an end block 566 is reached. If testing is not complete, from block 564 the determined profile block 554 is again reached and the process continues.

If the computed volume Vc is outside of the target volume at block 562, a block 570 may be reached with the deviation being indicated and/or displayed, followed by an end block 572 (or a return to block 554 for continued processing). Instead of reaching block 570 or, alternatively, from block 570, a decision block 574 may be reached. At block 574 a determination is made as to whether the computed volume is greater than or equal to Vmax, the maximum target volume. If the answer is yes, a block 576 is reached. At block 576, the combustion air-to-fuel ratio may be increased, e.g. additional air is added to the secondary port level of the furnace, to decrease the bed size. If at block 574 a determination is made the Vc, the computed volume, is not greater than or equal to Vmin, then Vc must be less than or equal to Vmin at this point in the process. In this case, a block 578 is reached and the air-to-fuel ratio may be decreased, e.g. at the primary port level. From blocks 576 and 578, the block 554 is again reached and a determination of the bed profile continues. Of course, other techniques for utilizing the computed bed volume information may also be used and would be apparent to those of ordinary skill in the art.

FIG. 18 illustrates a flow chart for utilizing the height characteristic of the bed, such as derived from the determined bed profile. At block 590, the process begins and continues to a block 592 at which time a maximum target height Hmax and a minimum target height Hmin is set, for example by the user utilizing interface 120 in FIG. 1. From block 592, a block 594 is reached and the profile of the bed is determined in accordance with the flow chart of FIG. 12 as previously explained. From block 594, a block 596 may be reached with the profile being displayed and the process ending at a block 598 (or returning to block 594 for further bed profile determinations). From block 596, or alternatively from block 594, a block 600 is reached. At block 600, the height of the bed is derived from the determined bed profile. The height Hdm may be determined from the Y values of the profile points as shown in FIG. 13. From block 600, a block 602 is reached at which time a determination is made as to whether the maximum determined height Hdm is greater than or equal to the maximum target height Hmax or less than or equal to the minimum target height Hmin. If the answer is no, a block 604 is reached at which time a determination is made as to whether the test is over. If testing is over, an end block 606 is reached. If not, the process returns to the determined profile block 594 and the next determination of a bed profile is made.

If at block 602 a determination is made that the determined height Hdm is outside of the target maximum and minimum heights (Hmax and Hmin), a block 608 may be reached, at which time the computed height Hdm is indicated or displayed and the process ends at block 610 (or continues to block 594 for further processing). Instead of reaching block 608, or from block 608, a block 611 may be reached. At block 611, a determination is made as to whether the computed height Hdm is greater than or equal to the maximum target height Hmax. If the answer is yes, the air-to-fuel ratio may be increased, (e.g. to the upper region of the bed), to cause a greater fuel consumption at such region and to thereby reduce the bed height. If at block 611 a determination is made that Hdm is not greater than or equal to Hmax, then Hdm must be less than or equal to Hmin at this point in the flow chart. In this case, from block 611, a block 614 is reached and the air-to-fuel ratio is decreased (e.g. at the upper region of the bed). As a result, the height of the bed is increased. In this manner, by adjusting the air-to-fuel ratio, or other parameters furnace operation as would be known to the operator of the furnace, the maximum bed height may be adjusted to more closely match the target height. From blocks 612 and 614, the process returns to block 594 and a determination of the bed profile continues.

The flow chart of FIG. 19 illustrates one approach for using the slope characteristics of the bed. In accordance with FIG. 19, from a start block 630, a block 632 is reached at which time a maximum slope Smax and minimum slope Smin is established. Smax and Smin may be established by the operator utilizing interface 120 (FIG. 1) and is typically of the greatest concern for Götaverken-type boilers. From block 632, a block 634 is reached and the profile of the bed is determined, for example in accordance with FIG. 12 as previously explained. From block 634, the profile may be displayed at a block 636 with the process ending at a block 638 (or continuing to block 634). From block 636, or alternatively from block 634, a block 639 may be reached. At block 639, the magnitude of the slope at various portions of the bed is determined. For example, with reference to FIG. 13, two slope computations, namely for slopes S1 and $2, are indicated at block 639. The slope may be computed at various locations along the determined bed profile in this manner. From block 639, at a block 640, a determination is made as to whether the computed slopes are greater than or equal to the maximum slope Smax or less than or equal to the minimum slope Smin. It should be noted, of course, that Smax and Smin may be varied so as to be different for the various locations along the bed profile. From block 640, the various slopes may be displayed, as indicated at block 642 and the testing ended at blocks 644 and 646 if the testing is complete at this point. If testing is not complete at block 644, the process may continue at the determined profile block 634. Alternatively, or in addition to displaying the resulting slopes, and following the branch through blocks 642, 644, etc., from block 640, a block 650 and/or a block 647 is reached. At block 647, this relationship between the computed slopes and target slopes (e.g. Smax and Smin) is displayed. From block 647, an end block 649 may be reached or the process may be continued to block 634 or block 650. At block 650, the values of the slopes S1, S2, and any other computed slopes for other locations, are compared to the target Smax and Smin values for the locations where the slopes have been determined.

In addition, at block 640 or at block 650, the operator may be alerted, as by a visual display or auditory alarm, that slopes are present which deviate from the target slopes. From block 650, a block 652 is reached. At block 652 the parameters of the furnace are adjusted to adjust the determined slopes to more closely match the target slopes Smax, Smin. In general, at block 652 the air-to-fuel ratio may be increased to those sections of the bed associated with a slope which is less than or equal to Smin to steepen the slope at such points. Conversely, the air-to-fuel ratio may be decreased at such locations where the slope is too steep to decrease the slope at such locations. Again, in a conventional boiler, the air supply at various levels in the boiler is controllable in a conventional manner and such controls may be utilized to adjust the bed configuration as a result of the determined bed profile or other bed characteristics. From block 652, the flow chart returns to block 634 and the process of determinating the bed profile continues.

As explained in greater detail below, the information concerning bed shape, volume and area (as well as other bed profile related characteristics), is particularly useful when combined with carryover particle and temperature information.

TEMPERATURE DETERMINATION SECTION

With reference to FIGS. 22–25, one preferred form of temperature determination section will next be described.

Prior to reaching the camera 400, a portion of the incoming signal from the interior of the furnace (by way of the vidicon tube 411 (FIG. 7) is diverted and utilized in the temperature determination. In particular, a temperature detector 700 is utilized for this purpose. The detector 700 includes a beam splitter 702, which directs fifty percent of the incoming radiation away from the infrared camera 400 and to a diode detector 704. The diode is preferably a germanium diode so as to be sensitive to a wavelength at which interference from fumes in the furnace are minimized. Positioned between the beam splitter 702 and diode 704 is an interference filter 706, which allows 1600 nm ±150 nm light to strike the surface of the diode. This wavelength is one of the windows recognized in U.S. Pat. No. 4,539,588 of Ariessohn as being a wavelength of minimal interference in a kraft chemical recovery furnace. A similar interference filter 708 is positioned between the beam splitter 702 and the input to the infrared camera 400. The germanium diode 704 is heated under the control of a thermostat by heater and thermostat unit 710 to 130° F. to avoid temperature drift from ambient room temperature. By restricting the wavelength to this narrow window, the energy of light received by the detector is proportional to the temperature, albeit non-linearly, so that temperature information can be extracted from the detected signal. The output of the detector 704 is amplified, by an amplifier not shown, and delivered by way of the line 441 (see also FIG. 7) to a linearizer circuit 716.

The linearizer circuit 716 is a "Comet Linearizer" available from $E^2$ Technology Corp. of Ventura, Calif., of the type normally used with other infrared diode detectors, but modified to accept inputs at the level provided by the germanium detector. This circuit utilizes zener diodes in series with variable resistors in a parallel combination as the feedback circuit for an operational amplifier. As a result, the operational amplifier output comprises a linear output in response to the non-linear input from the germanium diode detector. The output from the linearizer circuit is transmitted along a line 718 to a signal data injector circuit 720. In addition, the video output from the camera 400 is delivered by line 440 (see also FIG. 7) to the signal data injector. The signal data injector 720 converts the analog temperature data from the linearizer 716 into digital form and causes it to be injected or added to the video signal from camera 400 to provide a combined output at 112. This combined output is comprised of the video or image information from which the bed profile is determined and the temperature information from which bed temperature characteristics may be determined.

Figure 23:
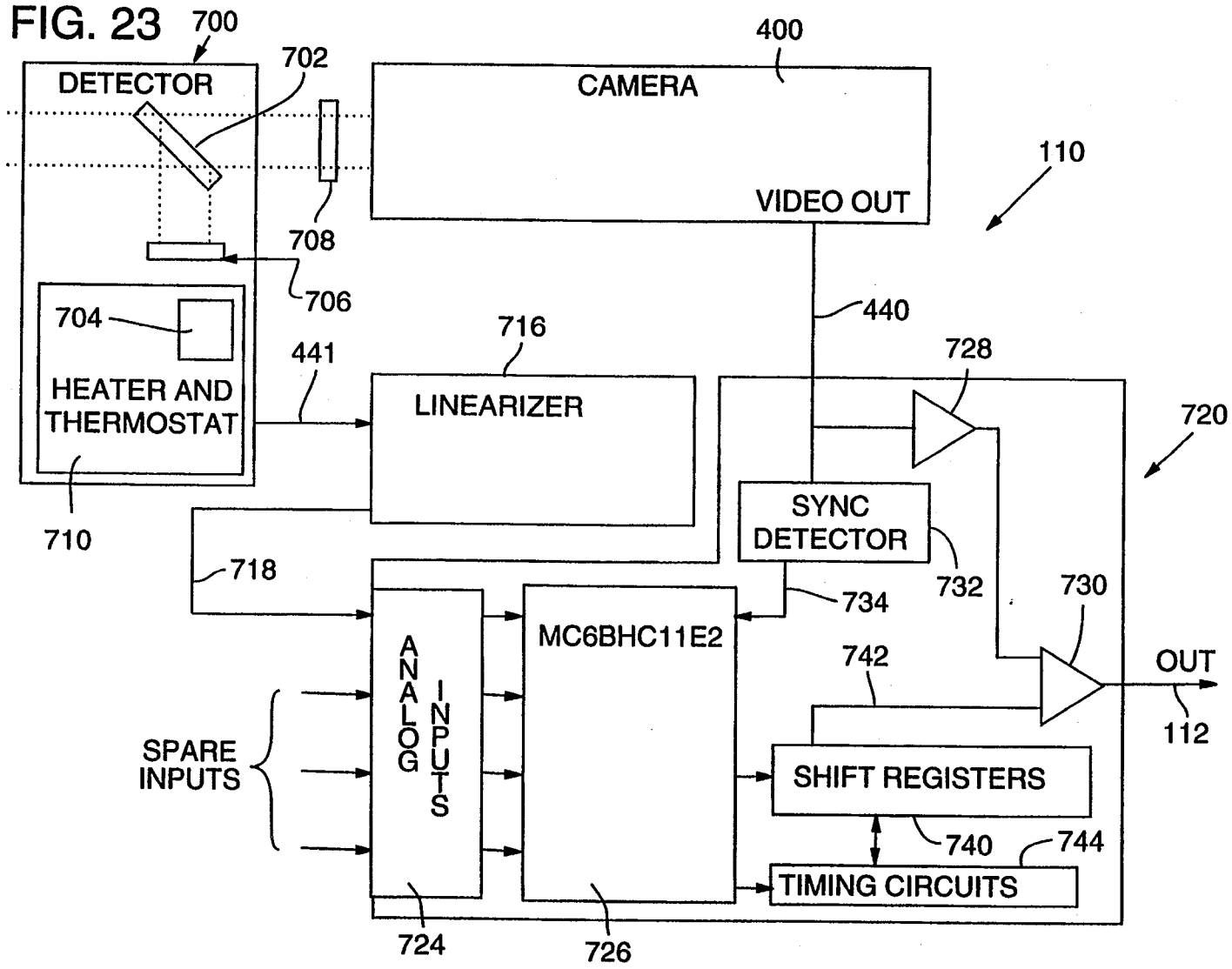
FIG. 23 is a more detailed diagram of the temperature determining section of FIG. 22.

With reference to FIG. 23, the output from the linearizer circuit 716 is fed to an analog input section 724 of the circuit 720. The analog input section consists of an operational amplifier which converts 4–20 mA data into 0–5 volt data. This data is fed to the port E of a microprocessor 726. The preferred microprocessor is a Motorola MC68HC11E2, which functions to digitize the incoming temperature data from the linearizer/analog input and the synchronization signal obtained from the video signal input to circuit 720. The microprocessor combines the video signal and temperature data into the output 112, which places the temperature data in the first few rows of the video scan. The operation of the microprocessor 726 will be best understood with reference to the discussion of the flow chart of FIG. 24 below.

The video signal from line 440 is amplified by an amplifier 728 and a summing operational amplifier 730 before delivery to the output line 112. A conventional sync signal detector circuit 732 monitors the incoming video signal 440 and sends a signal corresponding to the vertical sync pulse on a line 734 to the microprocessor 726. The sync detector circuit provides the timing for the microprocessor to add the temperature data to the output signal. Shift registers 740 receive parallel temperature data in the form of 8-bit bytes from the microprocessor together with a check sum. This data and check sum is held in the shift registers until the microprocessor causes it to clock out from the shift registers in serial form on line 742 to the operational amplifier 730. The amplifier 730 adds the temperature data to the original video signal to provide the composite output signal on line 112. The timing circuits 734 respond to signals from the microprocessor to hold the data in the shift registers 740 or clock the data out.

Figure 24:
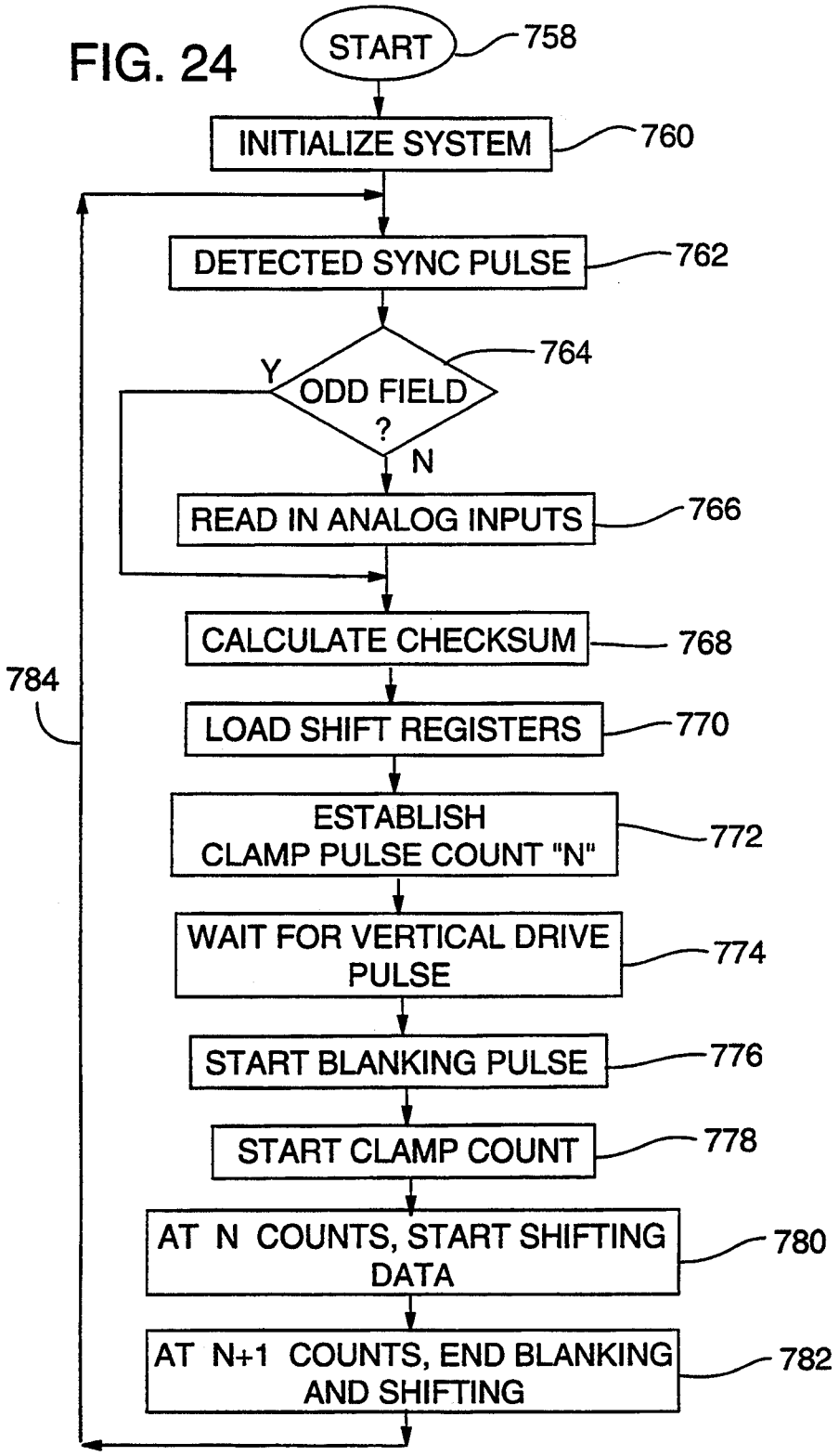
FIG. 24 is a flow chart illustrating one series of steps which may be utilized by a microprocessor during extraction of temperature data from the signal obtained from an image sensor viewing the bed.

The operation of the microprocessor 726 is best understood with reference to the flow chart of FIG. 24.

In this flow chart, following a start block 758, the microprocessor is initialized at block 760, at which time the values in registers 740 are set to zero. At block 762, the microprocessor waits for the detection of the vertical sync pulse by the sync detector 732. Following the detection of the sync pulse, at block 764, a determination is made as to whether the video signal being detected is an odd or even field of the interlaced video signal from the camera 400 (FIG. 7). In this specific example, temperature data is only read during even fields. Therefore, if the answer at block 764 is "yes," meaning an odd field is present, the process bypasses the block 766. Conversely, if the video field is an even field, block 766 is reached and the analog input containing the temperature information is read into the microprocessor. At block 768, a check sum is computed from the data for use by the processor 90 (FIG. 1) in verifying the accuracy of temperature data being delivered to the processor.

At block 770, the shift registers are loaded in parallel, while at block 772, a clamp pulse count "N" is established. "N" is the number of horizontal lines in the video which are to be blanked prior to the shifting of data from the shift registers into the combined output signal on line 112. Typically, anywhere from zero to 15 lines are blanked. At block 774, the microprocessor waits for the vertical drive pulse in the video signal, corresponding to the end of a field in the video signal. At this time, at block 776, a blanking pulse is started, and at block 778, the clamp count commences. At block 780, after the desired delay established by the clamp count "N" shifting of data from the shift registers to the amplifier 730 and thereby to output line 112 commences. At block 782, following the count "N" plus one, the blanking of the video signal ends, and shifting of data from the shift registers to the output line also ends. The process then returns by way of line 784 to wait for the next synchronization pulse.

Of course, a wide variety of suitable circuits may be used to combine temperature data with video information. In addition, instead of a combined signal, separate video and temperature signals may be obtained and delivered to the processor 90 (FIG. 1).

The temperature data may be processed by the processor 90 to determine the temperature of the bed. However, it is preferred that the data be processed to determine a mean temperature over a major portion of the bed, and most preferably over at least two-thirds of the bed area. The bed area is the area under the profile of the bed determined from a particular camera view. For reference purposes, a baseline may be established from which the bed profile is referenced, in which case, the selected portion of the bed for which temperature is being determined is under the bed profile boundary and above the bed reference. Additional information on furnace performance can be obtained from the locations of and temperatures of hot and cold spots on the bed. For example, a cold spot may indicate problems with fuel delivery to the bed or a lack of sufficient air to that portion of the bed, such that combustion is being hindered. Similarly, a localized hot spot may indicate other problems, such as an inadequate supply of fuel to the bed or too much air at the location of the hot spot. The indication of hot spots, together with excess carryover particles and bed shrinkage, provides an indication that too much fuel is being carried to the upper regions of the furnace, as opposed to being delivered to the bed.

Figure 25:
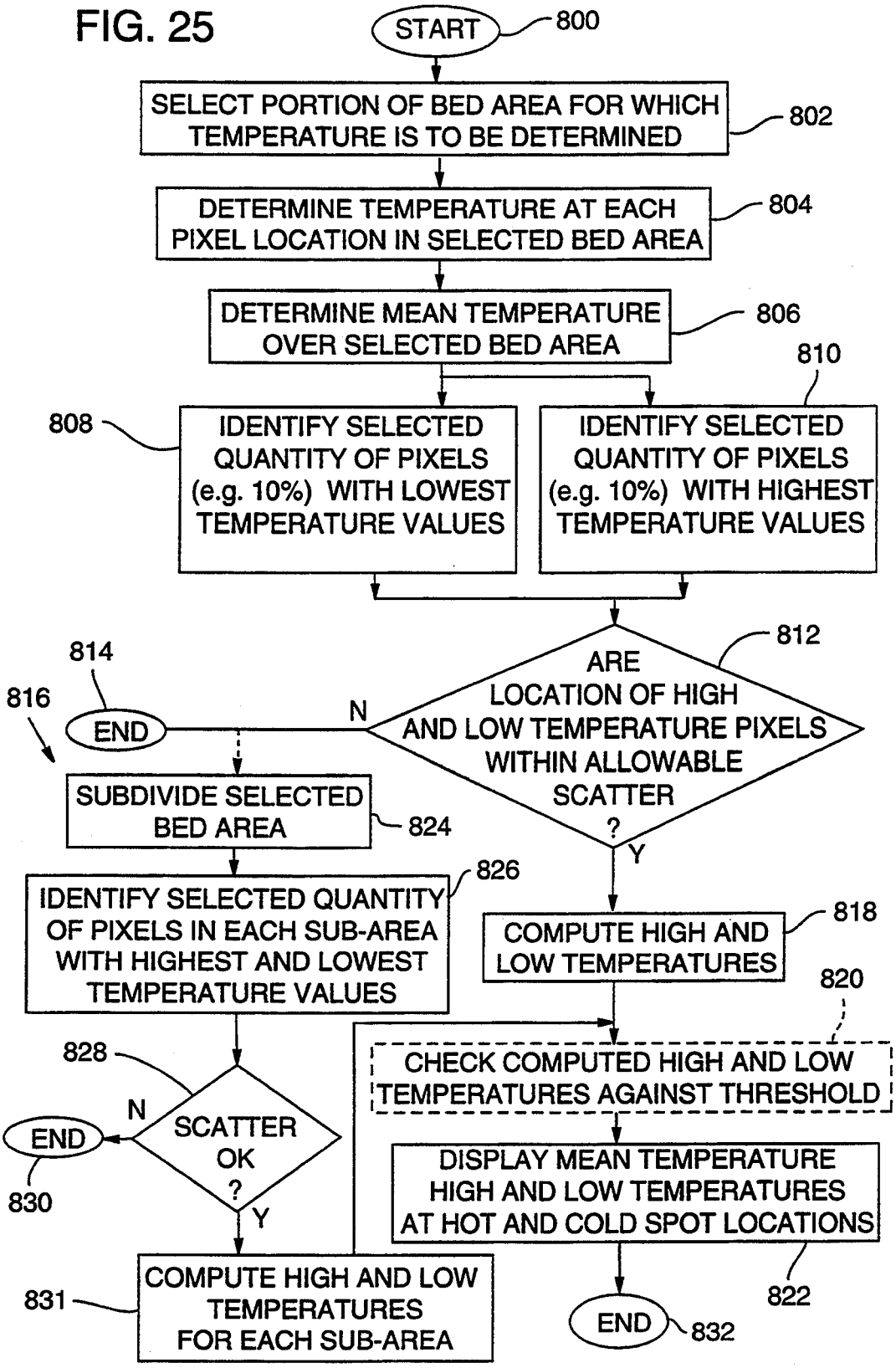
FIG. 25 is a flow chart illustrating one series of steps which may be utilized for determination of mean, high and low temperatures in the furnace.

Although more than one approach is available and suitable for determining bed temperature and the location of hot and cold spots on the bed, a preferred approach is indicated in FIG. 25. With reference to this figure, from a start block 800, a block 802 is reached, at which the portion of the bed area for which temperature is to be determined is selected. To provide meaningful information on overall furnace performance, it has been found that the area should be at least two-thirds of the area between the bed profile and any reference bed line, if the latter is used. In addition, as an option, to eliminate the impact of bed boundary locations on the temperature determination, the boundary of the bed for purposes of temperature determination may be spaced several pixels below the determined bed boundary.

At a block 804, the temperature is determined at each pixel location in the selected bed area. This can be done utilizing a look-up table of temperature values associated with intensity levels of pixels. In the preferred approach, a curve is generated using a black body radiation source. Specifically, for a given temperature from the source, an intensity level is determined. The temperatures from the source are varied to build up a table correlating the intensities with the known temperatures. For example, for a given temperature $T_1$ from the black body radiation source, an intensity $I_1$ is determined.

Also, a correlation step is performed to correlate the temperature readings from the pyrometer (detector 700, FIG. 22) to the curve determined in this manner. Initially, the pyrometer field of view is matched to the location in the camera field on which the pyrometer is focused. For example, a light source may be moved within the camera field of view until detected by the pyrometer. From the location of the light source, a precise determination of the portion of the image being detected by the pyrometer is made.

In the correlation step, for a pyrometer temperature $T_p$, an observed intensity $I_p$ is obtained. From the known $T_p$, using curve generated as explained above, an expected intensity, $I_{pe}$, can be obtained. Then, for a particular intensity at a pixel of particular interest, $I_{1a}$, the temperature for that area or pixel of interest is found by first multiplying $(I_{1a} \div I_p) \times I_{pc}$ to provide a value of $I_{1a}'$, a shifted intensity representation. From examining the curve at $I_{1a}'$ one can read the temperature for $I_{1a}'$, which provides the actual temperature at the pixel of interest.

Each of the pixels are examined in this same manner with the temperature for each pixel location being stored. Again, a look-up table can be generated using the curve generated by the black body radiation source, rather than computing each temperature for each pixel value. From block 804, the process reaches a block 806, and the mean temperature is determined by summing the temperatures for each of the pixels in the selected bed area and dividing this sum by the number of pixels in the area. In this way, by obtaining mean temperature information over a large selected bed area (and, most preferably, the entire bed area), meaningful information concerning the overall performance of the furnace becomes readily available. The mean temperature determined at block 806 may then be displayed.

As an added feature of the present invention, a mechanism is provided for determining hot and/or cold spots under the bed profile and in the bed area. Thus, from block 806, respective blocks 808 and 810 may be reached. At block 808, a selected quantity of pixels (e.g., 10 percent or another amount) with the lowest temperature values are identified. The identification includes determining the location of each of the low temperature pixels, a bit map of the image being used in a conventional manner for this purpose, together with the temperature associated with each location. In the same manner, at block 810, a selected quantity of pixels with the highest temperature values are identified.

Next, at block 812, a determination is made as to whether the location of the low temperature pixels are within an allowable scatter range, and whether the location of the high temperature pixels are within an allowable scatter range.

Preferably, for the low temperature pixels, the centroid $X_0$ of the pixels is identified. Assuming there are N pixels, the mean deviation S between the centroid and the pixel elements is determined using the following formula:

$$S = \sum_{i=1}^{N} \frac{1X_i - X_o1}{N}$$

If the mean deviation S is greater than a constant, or some other scatter maximum, a low temperature location is not indicated at block 812. The process may then end at block 814, or an alternative procedure, indicated generally at 816 in FIG. 25, may be followed.

To establish the allowable scatter, one preferred approach is to approximate the area of the low temperature pixels. Thus, the scatter area $S_A$ may be approximated using a circular approximation of $S_A = \pi S^2$. If the scatter area is then less than or equal to a selected percentage of the total bed area under the profile (e.g., less than or equal to 1/10th of the bed area), acceptable scatter is indicated and the location of the low temperature spot is determined at the centroid of the low temperature pixels. In the same manner, the high temperature pixels may be checked for acceptable scatter. From block 812, block 818 is reached with the high and low temperatures for the hot and cold spots being determined. The temperature values of the pixels included in the high temperature pixel set and in the low temperature set may be respectively averaged to determine these values.

At block 820, an optional step is performed of comparing the high and low temperatures against a threshold to determine whether the temperatures qualify for display. One convenient threshold is to ask whether the difference between the hot spot temperature and the mean temperature divided by the mean temperature is greater than some value, such as 15 percent. Similarly, for a cold spot to qualify, one can determine whether the difference between the cold temperature and the mean temperature divided by the mean temperature is less than 15 percent. Temperatures not qualifying against this threshold may simply not be displayed. At block 822, the mean temperature is displayed, together with the high and low temperatures. In addition, because the location of the hot and cold spots are known from the centroid of the pixels used in determining these respective hot and cold spots, the locations of the hot and cold spots may be displayed under the bed profile at the locations of the bed area where these conditions exit.

Returning to block 812, assuming the hot and cold pixels are not within the allowable scatter, rather than ending the procedure at block 814, one can examine the data for plural hot and cold spots. Thus, in accordance with the subroutine 816, at block 824, the bed area may be subdivided, for example, into quadrants. Then, at block 826, a selected quantity of pixels in each subarea with the highest and lowest temperature values may be examined in the same manner as was done at blocks 808 and 810. Thereafter, at block 828, an inquiry is made as to whether the scatter of the pixels in each of the quadrants is acceptable. If not, the procedure may end at block 830. If so, high and low temperatures for each subarea may be determined at block 831, with the process then continuing at blocks 820, 822 and 832. When the subroutine 816 is followed, a potential exists of displaying more than one hot or cold spot on the bed image. This will provide a boiler operator with additional information on how the boiler is performing.

Figure 26:
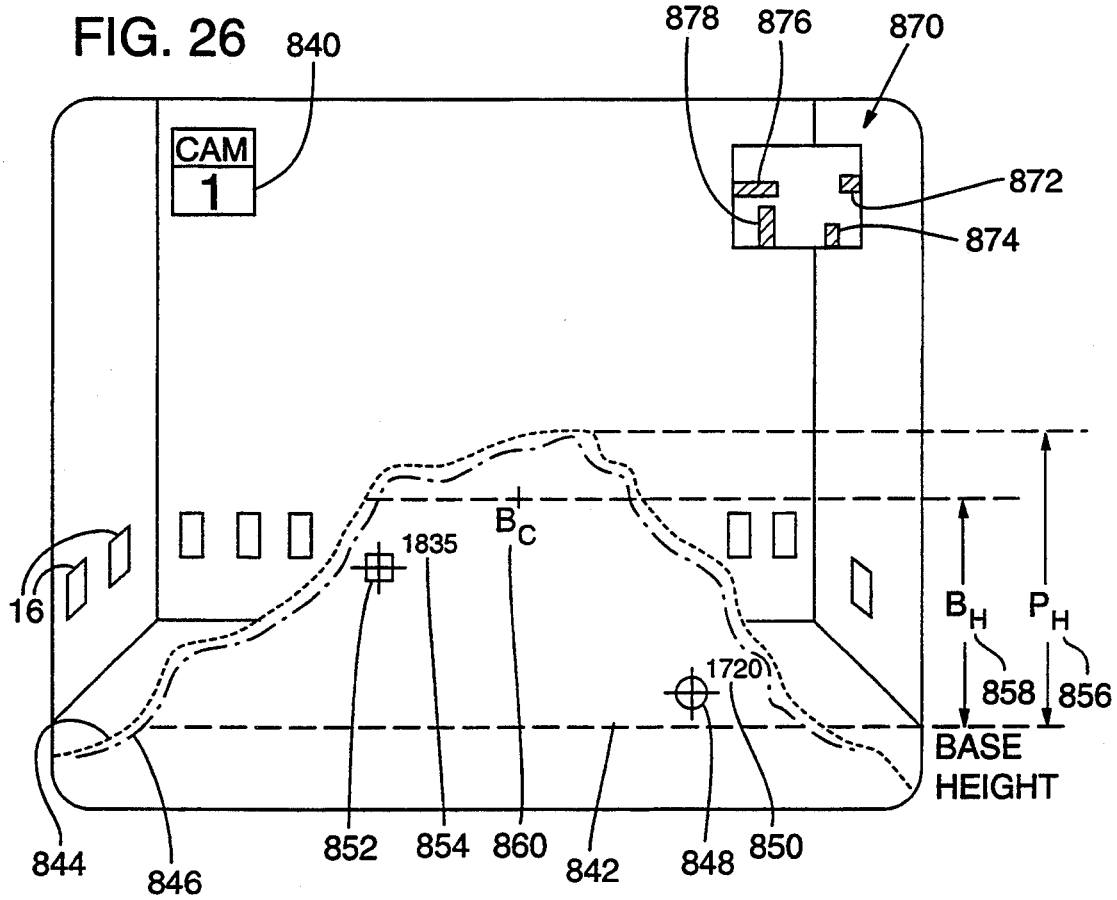
FIG. 26 is a schematic representation of a screen of a video display terminal obtained in accordance with the method and apparatus of the present invention.

FIG. 26 represents a typical screen being viewed at the display 116 (FIG. 1). In particular, this display is of data derived from camera 1, one of the plural cameras 400 (FIG. 7) being used in the monitoring system of the present invention. In addition to depicting ports, such as 16 visible in the image, the camera number is identified at 840 for ready observation by the operator of the furnace. This figure also illustrates a baseline 842, below which data is disregarded as being unreliable. The baseline may be arbitrarily established, such as the lowest 10 percent of the image being viewed by the camera. The bed profile determined as explained above is indicated by the dashed line 844. Another line, 846, not typically shown in a displayed image, may be used to define the upper boundary of those pixels used for determining temperature to avoid pixels at the edge of the bed. That is, the line 846, although exaggerated in this figure, is typically a few pixels (one to five pixels) below the line 844. The location of a cold spot is indicated at 848, and the temperature at the cold spot is indicated at 850. Similarly, the location and temperature of a hot spot is indicated respectively at 852 and 854. Thus, an operator viewing this screen can immediately relate the location of the hot and cold spots, together with their magnitudes, to their position on the smelt bed 30 within the furnace. Also, as indicated in this figure, the peak height of the bed profile 856 is shown, together with the height of a top bar (indicated by $B_h$) at 858. Changes in the width of the top bar indicates a change in the size and/or shape of the bed. Changes in the elevation of the top bar indicates that the bed, exclusive of peaks, is growing or decreasing in height. At 860, the top bar center, $B_c$, is indicated. The location of $B_c$ in the furnace, e.g., to the left or right of the center of the furnace, may indicate that the bed is growing or changing in an unstable manner.

Also, at 870 is a display which graphically represents the carryover particle information. In the monitoring system represented by FIG. 26, four of the detectors 96 are being used. The length of the bars 872, 874, 876 and 878 indicate the magnitude of the detected carryover particles. In addition, the position of the bars relative to the boundary of this display subarea 870 corresponds to the position of the detectors about the periphery of the furnace. By observing magnitudes and/or changes in the detected carryover particles and the location of the detected particles, as indicated by graphical display 870, the operator is in a position to adjust the furnace parameters to control excessive carryover particles.

Figure 27:
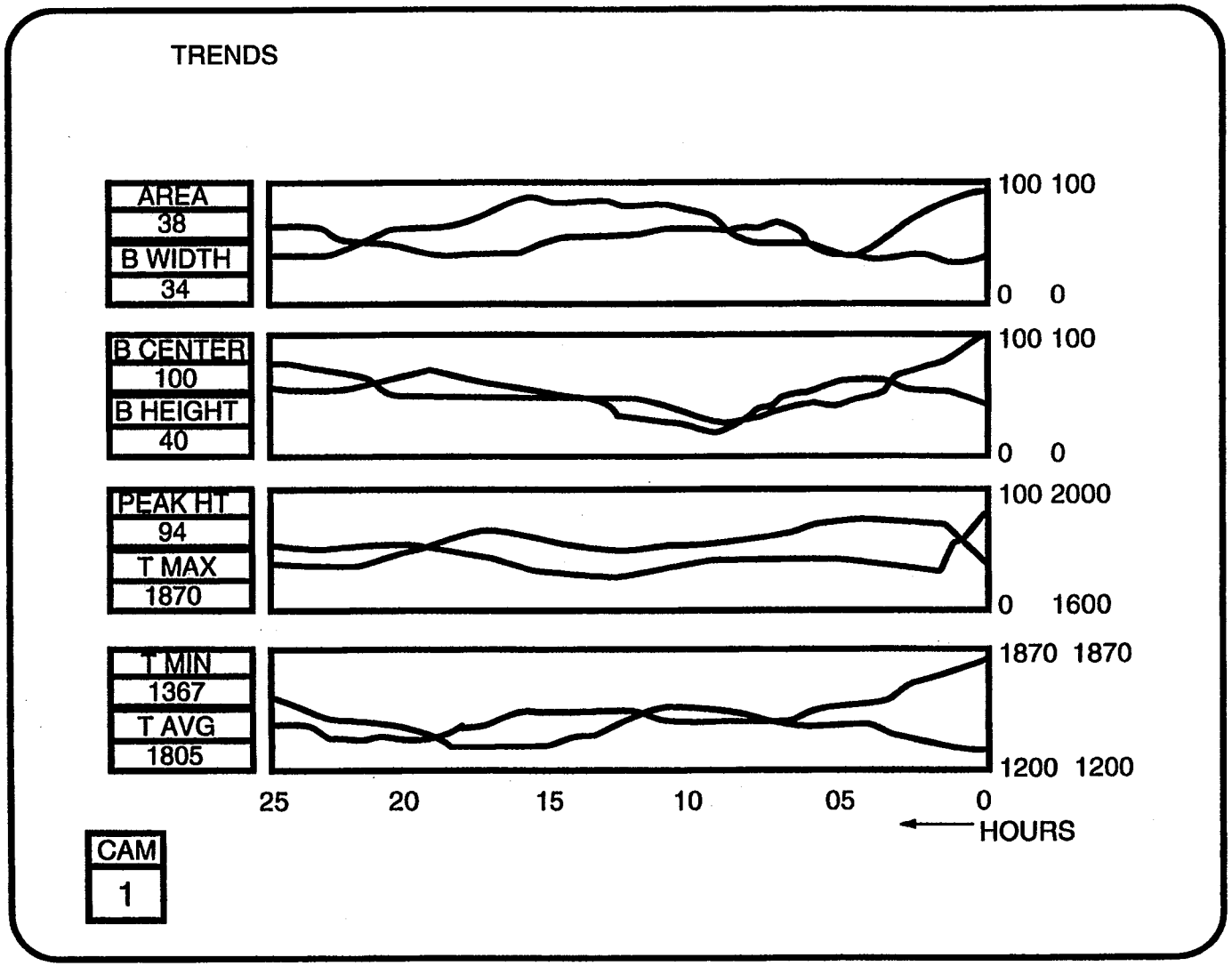
FIG. 27 is a schematic representation of a screen of a video display terminal generated by the method and apparatus of the present invention, and showing displays of selected monitored furnace parameters.

Trend information is also available for review by the operator, such as indicated by FIG. 27. In this case, changes in the area of the bed, the width of the top bar, the position of the top bar, the position of the top bar center, the peak bed height and the temperature information trends over time is displayed.

In a typical installation of a monitoring system in accordance with the present invention utilizing two cameras and six detectors for detecting carryover particles, over 20 parameters of furnace operation can be obtained. That is, each of the two cameras 110 provides, in this specific example, eight outputs corresponding to the bed profile, the bed peak, the top bar location, the top bar center location, and bed area (or volume). In addition, the slope of the bed profile is also available. Furthermore, each camera provides information from which the mean bed temperature is determined and displayed, high temperature and low temperature spots are located, and the temperatures associated therewith are displayed. Also, the particle counts at the various carryover particle detectors are obtained and displayed.

From observing this information, an operator of a furnace can input commands either at the process computer 28 location (FIG. 1) or at the keyboard 120 to cause the adjustment of furnace operating conditions. In addition, the information may be, for example, downloaded directly to the process computer 28 for use in automatically adjusting the furnace parameters in response the observed characteristics.

In addition, a diagnostic and furnace adjustment table may be developed utilizing this information. An exemplary table developed through a theoretical analysis of the expected performance of a black liquor furnace is set forth below, as Table 1. In practice, data on a particular furnace is accumulated over time to confirm and update entries on such a table. When the table is complete and verified, one can monitor the bed profile, temperature and carryover particle information provided by the present invention and use this information in conjunction with the table in diagnosing problems and for furnace control purposes. In this table, U stands for increasing; D stands for decreasing; X stands for the existence of at least one hot or cold spot on the bed area; P stands for more sharply peaked (bed profile); I stands for imbalanced (bed leaning to one side or particles excessive in localized area); and F stands for a flattened bed profile.

TABLE 1

| Contributors To and Effects of Combustion Problems in the Lower Furnace | | | | | | |
|---|---|---|---|---|---|---|
| Bed Shape | Hot/Cold Spots | Temp | Bed Volume or Area | Carryover Particles | Problem | Cause |
| | | | | | Air Supply Problems | |
| I | X | D | U | U | | Ports Blocked |
| F | | D | U | D | | Pressure Low |
| F | | D | U | D | | Flow Low |
| I | X | U | D | U | | Flow Unbalanced |
| | | | | | Fuel Not Dry When It Reaches Bed | |
| P | X | D | U | D | | Gun Angle Too Low |
| P | X | D | U | D | | Viscosity Too High |
| P | X | D | U | D | | Pressure Too Low |
| I | X | | | U | | Nozzle Fouled |
| F | | D | U | D | | Liquor Solids Low |
| F | | U | | D | | Heat Value of Liquor Low |
| | | | | | Fuel Doesn't Reach Bed | |
| F | | U | D | U | | Gun Angle Too High |
| P | | D | D | U | | Pressure Too High |
| F | | D | D | U | | Viscosity Too Low |
| | | | | | Combustion Process Stops | |
| P | | D | U | D | | Global (Blackout) |
| P | X | D | U | D | | Local (Cold Spots) |
| | | | | | Liquor Distribution Unbalanced | |
| I | | | | I | | Guns Different Size or Fouled |
| I | | | | I | | Guns Different Pressure |
| | | | | | Air Temperature | |
| F | | D | U | | | Too Low |
| P | | U | D | U | | Too High |

I = Side to Side Imbalance

Consider, for example, the entries in Table I related to fuel viscosity too high or two low. If the fuel viscosity is too high (e.g. the fuel temperature is too low), the detected carryover particles drop, indicated by the letter "D" at the intersection between the column associated with carryover particles and the row associated with the viscosity being too high. The reason for carryover particles decreasing is, again, that the drops tend to be bigger and do not dry as much as they travel from the gun to the bed. Therefore, the fuel tends to be too wet when reaching the bed. As a result, little fuel is dried out and carried up with air to the upper region of the furnace. In addition, the bed volume is going up, as indicated by the "U" in the "Bed Volume or Area" column, due to the increase in fuel being delivered to the bed arising because of the wetness of the fuel. Also, as indicated by the "D" corresponding to a decreasing temperature in the temperature column, the mean bed temperature tends to drop due to the wet fuel reaching the bed. Furthermore, the presence of a cold spot, indicated by the "X" in the "Hot/Cold Spots" column, would occur due to the wet fuel reaching the bed. Also, the position of the cold spot on the bed at a location at which one could expect fuel from a gun to reach the bed under these adverse operating conditions is a further indicator that the fuel temperature is too low. Furthermore, the bed tends to become more peaked as indicated by the P in the "Bed Shape" column.

Conversely, if the fuel temperature is too high, the viscosity of the fuel is too low and the carryover particles go up, as indicated by the "U" in the "Carryover Particles" column adjacent to the Gun Angle Too High row. A high fuel temperature results in smaller fuel particles which are dried to a greater extent and tend to become excessively dry before reaching the bed. In these cases, more of the fuel is being carried upwardly to upper regions of the furnace as carryover particles, due to the lightness of the fuel when dried. In addition, the bed volume tends to decrease, as indicated by the "D" in the "Bed Volume or Area" column, due to a lessening of the fuel reaching the bed. Also, the temperature of the bed tends to go up, as indicated by the "U" in the temperature column, because the air-to-fuel ratio has increased as a result of a lesser amount of fuel reaching the bed. In addition, the bed tends to flatten as indicated by the F in the "Bed Shape" column.

Thus, it is apparent that for many operating parameters of a furnace, the bed temperature, bed profile, and carryover particle information all interact to provide an indication of the performance of the furnace. A lack of any of this information lessens the ability to monitor and control a kraft chemical recovery furnace.

As another specific example, the localized isolation of hot spots may indicate that particular air supply ports are blocked (see the second row of data in Table 1). Consequently, a pattern of rodding or cleaning the air supply ports can be determined from the observed furnace operating characteristics. That is, blocked air ports can be identified and rodded or cleaned. Also, by observing the frequency at which particular ports become plugged, a rodding pattern (frequency of rodding particular ports) can be developed.

In addition to monitoring and controlling the performance of a furnace, optimization of furnace operating parameters can also be achieved.

Figure 28:
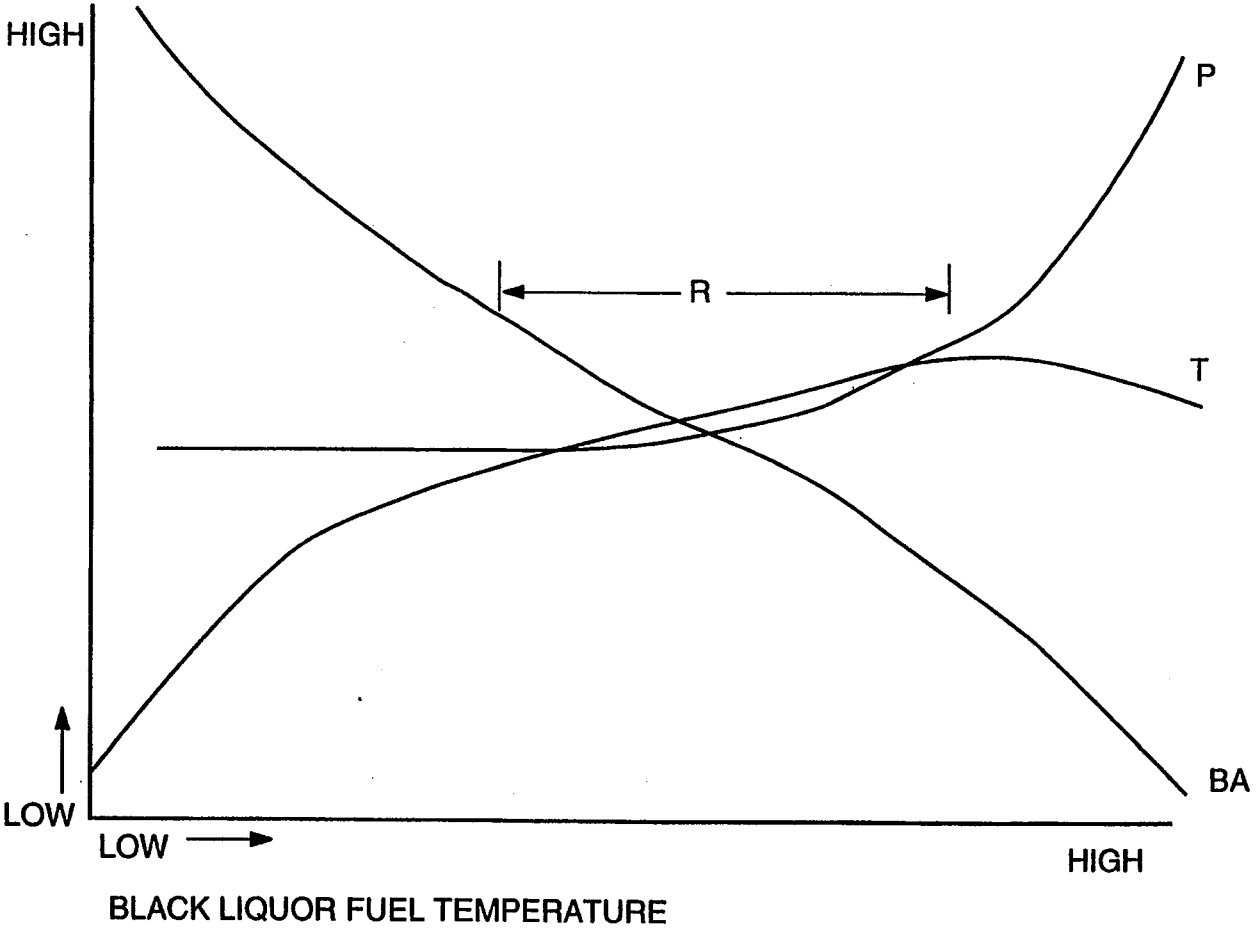
FIG. 28 is a schematic representation of the theoretical interaction of three parameters to illustrate in a limited way the use of the present invention in optimizing furnace operating parameters.

For example, FIG. 28 illustrates the theoretical interaction of the fuel temperature with the particle (P), temperature (T), and bed area (BA) characteristics. Again, as fuel temperature increases, the bed temperature T shifts from a low level at the far left of this figure through a mid-region and generally stabilizes or drops off slightly as the fuel temperature reaches a higher level. The low bed temperature at the left of this figure corresponds to the furnace moving toward a black-out condition where combustion ceases due to the large drops of wet fuel being sprayed onto the bed. Similarly, the bed area decreases somewhat sharply as the fuel temperature is increased. This also corresponds to the amount of fuel reaching the bed as with higher fuel temperatures the fuel drops are smaller and less fuel reaches the bed. Particles, on the other hand, tend to follow a relatively stable path until the fuel temperature becomes high, at which time the particles begin to increase due to smaller fuel particles being dried and carried up with air to upper regions of the furnace.

By fixing furnace operating parameters, except for fuel temperature, and thereafter adjusting the fuel temperature for optimum conditions, one can adjust the fuel temperature to provide temperature, bed area and carryover particle levels within the acceptable range indicated by "R" in FIG. 28. Thereafter, one can adjust another characteristic of the furnace, such as fuel pressure, while maintaining the other parameters constant. By iteratively adjusting the furnace operating parameters, one can more closely move toward an optimum furnace performance, wherein the capacity of the furnace is enhanced without producing excessive carryover particles, and while maintaining a stable bed configuration and bed temperature.

Having illustrated and described the principles of our invention with reference to several preferred embodiments, it should be apparent to those ordinarily skilled in the art that this invention may be modified in arrangement and detail without departing from such principles. For example, the image processing techniques for determining transitions in a bed profile may be modified with the goal being to enhance the determination of transitions, and thus, the determined profile relative to the actual bed profile. In addition, the flow charts and other examples relating to the use of the determined furnace characteristics may be modified as suitable for the particular furnace of interest and for compatibility with procedures adopted by the operators of such furnaces. We claim as our invention all such modifications as fall within the scope of the following claims.

We claim:

1. An apparatus for use in monitoring a kraft chemical recovery furnace of the type in which black liquor fuel is injected into a combustion chamber and burned therein to form a bed of chemicals to be recovered, the apparatus comprising:

means for determining the profile of the bed viewed from at least one direction and for producing a first output signal representing the bed profile;

means for determining the temperature of the bed over at least a major portion of the bed profile and for producing a second output signal representing the temperature of the bed;

means for detecting particles in an upper region of the furnace and for producing a third output signal representing the detected particles; and means for displaying from the first, second and third output signals a visual representation of the determined profile of the bed, the determined temperature of the bed and the detected particles.

2. A method for use in monitoring a kraft chemical recovery furnace of the type in which black liquor fuel is injected into a combustion chamber and burned therein to form a bed of chemicals to be recovered, the method comprising:

determining the profile of the bed viewed from at least one direction and producing a first output signal representing the bed profile;

determining the temperature of the bed over at least a major portion of the bed profile and producing a second output signal representing the temperature of the bed;

detecting particles in an upper region of the furnace and producing a third output signal representing the detected particles;

displaying from the first, second and third output signals a visual representation of the determined profile of the bed, the determined temperature of the bed and the detected particles;

wherein air is supplied to the furnace at plural levels within the furnace and at plural locations about the furnace at each level, and in which fuel is supplied to the furnace through at least one fuel gun or nozzle aimed into the furnace at an angle relative to horizontal, at a fuel temperature and at a fuel pressure, the method including the step of correlating the determined bed profile, determined temperature, and detected particles with furnace operating parameters selected from the group comprising the fuel nozzle angle, the fuel temperature, the fuel pressure, and the supply of air to the furnace at the plural levels and locations; and the method including the step of adjusting the furnace operating parameters in response to the determined bed profile, determined temperature and detected particles and further including the step of cleaning out the air delivery locations in response to variations in the determined bed profile, determined temperature, and detected particles.

3. A method for use in monitoring a kraft chemical recovery furnace of the type in which black liquor fuel is injected into a combustion chamber and burned therein to form a bed of chemicals to be recovered, the method comprising:

determining the profile of the bed viewed from at least one direction and producing a first output signal representing the bed profile;

determining the temperature of the bed over at least a major portion of the bed profile and producing a second output signal representing the temperature of the bed;

detecting particles in an upper region of the furnace and producing a third output signal representing the detected particles;

displaying from the first, second and third output signals a visual representation of the determined profile of the bed, the determined temperature of the bed and the detected particles;

determining the profile of the bed step comprising the step of producing a digital image of the bed and background and processing the image to determine transitions in the image which correspond to transitions between the bed and background and thereby to the boundary of the bed; and wherein the digital image is comprised of successive vertical slices or columns of pixels, the step of processing the image to determine transitions comprises the step of repeatedly evaluating pixels within each vertical slice of the bed profile to determine the transition between the bed and image associated with the vertical slice, the pixels evaluated in determining the transition for a given evaluation being within a predetermined number of pixels of the pixel determined as the transition during the preceding evaluation.

4. A method for use in monitoring a kraft chemical recovery furnace of the type in which black liquor fuel is injected into a combustion chamber and burned therein to form a bed of chemicals to be recovered, the method comprising:

determining the profile of the bed viewed from at least one direction and producing a first output signal representing the bed profile;

determining the temperature of the bed over at least a major portion of the bed profile and producing a second output signal representing the temperature of the bed;

detecting particles in an upper region of the furnace and producing a third output signal representing the detected particles;

displaying from the first, second and third output signals a visual representation of the determined profile of the bed, the determined temperature of the bed and the detected particles;

determining the profile of the bed step comprising the step of producing a digital image of the bed and background and processing the image to determine transitions in the image which correspond to transitions between the bed and background and thereby to the boundary of the bed; and wherein the digital image is comprised of pixels, the step of determining the bed profile including the step of identifying at least one selected element in the background, assigning a value for pixels associated with the selected element to minimize such associated pixels being determined as a transition.

5. A method according to claim 4 in which the value for pixels associated with the selected element is reassigned with each determination of transitions to minimize such associated pixels being determined as a transitions.

6. A method according to claim 4 in which the value for each pixel associated with the selected element are assigned by averaging the values of plural pixels proximate to the associated pixel.

7. A method for use in monitoring a kraft chemical recovery furnace of the type in which black liquor fuel is injected into a combustion chamber and burned therein to form a bed of chemicals to be recovered, the method comprising:

determining the profile of the bed viewed from at least one direction and producing a first output signal representing the bed profile;

determining the temperature of the bed over at least a major portion of the bed profile and producing a second output signal representing the temperature of the bed;

detecting particles in an upper region of the furnace and producing a third output signal representing the detected particles;

displaying from the first, second and third output signals a visual representation of the determined profile of the bed, the determined temperature of the bed and the detected particles;

determining the profile of the bed step comprising the step of producing a digital image of the bed and background and processing the image to determine transitions in the image which correspond to transitions between the bed and background and thereby to the boundary of the bed; and wherein the digital image is comprised of pixels, the step of processing the image to determine transitions comprises the step of determining transitions from the method of simulated thermal annealing by applying the thermodynamic relationship ($e^{-u/t}$) wherein u is a positive function of the group comprising the height of the pixel, the strength of the pixel, the memory of the pixel and continuity of the pixel and T is a simulated temperature.

8. A method according to claim 7 in which the digital image is comprised of successive vertical slices or columns of pixels, the step of processing the image to determine transitions comprises the step of repeatedly evaluating pixels within each vertical slice of the bed profile to determine the transition between the bed and image associated with the vertical slice, the pixels evaluated in determining the transition for a given evaluation being within a predetermined number of pixels of the pixel determined as the transition during the preceding evaluation.

9. A method according to claim 7 in which the digital image is comprised of pixels, the step of determining the bed profile includes the step of identifying at least one selected element in the background, assigning a value for pixels associated with the selected element to minimize such associated pixels being determined as a transition.

10. A method according to claim 9 in which the value for pixels associated with the selected element is reassigned with each determination of transitions to minimize such associated pixels being determined as a transition.

11. A method according to claim 10 in which the value for each pixel associated with the selected element are assigned by averaging the values of plural pixels proximate to the associated pixel.

12. A method for use in monitoring a kraft chemical recovery furnace of the type in which black liquor fuel is injected into a combustion chamber and burned therein to form a bed of chemicals to be recovered, the method comprising:

determining the profile of the bed viewed from at least one direction and producing a first output signal representing the bed profile;

determining the magnitude of the average temperature of the bed over at least a major portion of the bed profile and producing a second output signal representing the magnitude of the average temperature of the bed;

detecting particles in an upper region of the furnace and producing a third output signal representing the detected particles; and displaying from the first, second and third output signals a visual representation of the determined profile of the bed, the determined magnitude of the average temperature of the bed and the detected particles.

13. A method according to claim 12 in which the step of displaying comprises the step of simultaneously displaying the determined profile of the bed, the determined magnitude of the average temperature of the bed and the detected carryover particles on a common screen.

14. A method according to claim 12 including the step of determining a mean bed temperature over substantially the entire bed area and displaying the mean bed temperature.

15. A method according to claim 12 including the step of determining a mean bed temperature over at least two-thirds of the bed area.

16. A method according to claim 12 including the step of detecting particles at plural locations of the upper region of the furnace and in which the displaying step comprises the step of visually displaying the detected particles graphically in association with the location of the furnace in which the particles are detected.

17. A method according to claim 12 in which the determining the profile of the bed step comprises the step of producing a digital image of the bed and background and processing the image to determine transitions in the image which correspond to transitions between the bed and background and thereby to the boundary of the bed.

18. A method according to claim 17 in which the displaying the profile of the bed step includes the step of displaying the determined profile of the bed, the method including the step of selecting at least one bed characteristic from the group of bed characteristics including at least the area of the bed, peak height of the bed, the width of the bed at a bar location which is a selected height below the peak, and the center of the bed at the bar location, and the step of displaying the selected characteristics with the determined bed profile.

19. A method according to claim 12 in which the temperature determining step includes the step of determining at least one low temperature location under the bed profile and at least one high temperature location under the bed profile and the displaying step comprising the step of displaying the high and low temperature locations under the displayed profile of the bed.

20. A method according to claim 19 also including the step of determining and displaying the magnitudes of high and low temperatures of the bed.

21. A method according to claim 20 in which the step of determining the high and low temperatures comprise the step of providing an average value of high and low temperatures determined from selected portions of the bed under the profile.

22. A method according to claim 12 in which air is supplied to the furnace at plural levels within the furnace and at plural locations about the furnace at each level, and in which fuel is supplied to the furnace through at least one fuel gun or nozzle aimed into the furnace at an angle relative to horizontal, at a fuel temperature and at a fuel pressure, the method including the step of correlating the determined bed profile, determined temperature, and detected particles with furnace operating parameters selected from the group comprising the fuel nozzle angle, the fuel temperature, the fuel pressure, and the supply of air to the furnace at the plural levels and locations.

23. A method according to claim 22 including the step of storing the correlations over time to create a history of the correlations of furnace operating parameters to the determined bed profile, determined temperature and detected particles.

24. A method according to claim 22 including the step of adjusting the furnace operating parameters in response to the determined bed profile, determined temperature and detected particles.

* * * * *